US007344335B2

(12) United States Patent
Burkhart

(10) Patent No.: US 7,344,335 B2
(45) Date of Patent: Mar. 18, 2008

(54) METHODS AND MODULES FOR AN UNDERGROUND ASSEMBLY FOR STORM WATER RETENTION OR DETENTION

(75) Inventor: Philip J. Burkhart, Mazon, IL (US)

(73) Assignee: StormTrap LLC, Morris, IL (US)

( * ) Notice: Subject to any disclaimer, the term of this patent is extended or adjusted under 35 U.S.C. 154(b) by 0 days.

(21) Appl. No.: 11/567,869

(22) Filed: Dec. 7, 2006

(65) Prior Publication Data

US 2007/0099477 A1 May 3, 2007

Related U.S. Application Data

(63) Continuation of application No. 11/255,398, filed on Oct. 21, 2005, now Pat. No. 7,160,058, which is a continuation of application No. 10/272,851, filed on Oct. 17, 2002, now Pat. No. 6,991,402.

(51) Int. Cl.
*E01F 5/00* (2006.01)
*E03F 3/00* (2006.01)

(52) U.S. Cl. ..... 405/36; 405/126; 52/169.2; 52/169.6

(58) Field of Classification Search ..... 405/36, 405/38, 43, 46, 50, 51, 118, 124, 126; 52/86–89, 52/169.1, 169.2, 169.6
See application file for complete search history.

(56) References Cited

U.S. PATENT DOCUMENTS

| | | | |
|---|---|---|---|
| 862,292 | A | 8/1907 | Stoffer |
| 925,019 | A | 6/1909 | Parks et al. |
| 1,028,638 | A | 6/1912 | Thorsby |
| 1,060,271 | A | 4/1913 | McBean et al. |
| 1,144,200 | A | 6/1915 | Hewett |

(Continued)

OTHER PUBLICATIONS

Advanced Drainage Systems, Inc., "When was the last time a footprint meant so much?", Advertisement, Stormwater, Sep./Oct. 2002, p. 3.

(Continued)

*Primary Examiner*—Tara L. Mayo
(74) *Attorney, Agent, or Firm*—Cook, Alex, McFarron, Manzo, Cummings & Mehler, Ltd.

(57) ABSTRACT

Methods and modules for use in a modular assembly are disclosed for retaining or detaining storm water beneath a ground surface. A module comprises a substantially horizontally disposed deck portion and at least one substantially vertically disposed side portion extending therefrom. The deck portion and side portion have respective end edges, and the side portion has bottom edges. The side portion and the deck portion define a longitudinal channel which is open at least at an end of the module. The side portion has at least one opening therein and defines a lateral channel in the module. The longitudinal and lateral channels are in fluid communication with one another. Each channel has about the same cross section and extends upwardly from the bottom edges to allow relatively unconstrained flow in the longitudinal and lateral directions.

20 Claims, 26 Drawing Sheets

U.S. PATENT DOCUMENTS

| | | | |
|---|---|---|---|
| 1,184,634 | A | 5/1916 | Duerrwachter |
| 1,349,166 | A | 8/1920 | Paff |
| 1,412,616 | A | 4/1922 | Kammerer et al. |
| 1,453,136 | A | 4/1923 | Hitchcock |
| 3,339,366 | A | 9/1967 | Gogan et al. |
| 3,570,251 | A | 3/1971 | Roberts |
| 3,910,051 | A | 10/1975 | Komisarek |
| 4,141,666 | A | 2/1979 | DeGraff |
| 4,211,504 | A | 7/1980 | Sivachenko |
| 4,239,416 | A | 12/1980 | Borca et al. |
| 4,523,613 | A | 6/1985 | Fouss et al. |
| 4,595,314 | A | 6/1986 | Lockwood |
| 4,638,920 | A | 1/1987 | Goodhues, Jr. |
| 4,687,371 | A | 8/1987 | Lockwood |
| 4,759,661 | A | 7/1988 | Nichols et al. |
| 4,797,030 | A | 1/1989 | Lockwood |
| 4,854,775 | A | 8/1989 | Lockwood |
| 4,993,872 | A | 2/1991 | Lockwood |
| 5,336,017 | A | 8/1994 | Nichols |
| 5,401,116 | A | 3/1995 | Nichols |
| 5,624,204 | A | 4/1997 | Dorsemaine |
| 5,810,510 | A | 9/1998 | Urriola |
| 5,836,716 | A | 11/1998 | Johnson et al. |
| 5,890,838 | A | 4/1999 | Moore, Jr. et al. |
| 6,004,067 | A | 12/1999 | Peppard |
| 6,221,445 | B1 | 4/2001 | Jones |
| 6,277,274 | B1 | 8/2001 | Coffman |
| 6,361,248 | B1 | 3/2002 | Maestro |
| 6,368,017 | B2 | 4/2002 | Black |
| 2004/0182017 | A1 | 9/2004 | Heierli |

OTHER PUBLICATIONS

STORMTECH, "Profit from the ground up with StormTech's gold chambers", Advertisement, Stormwater, Sep./Oct. 2002, p. 11.

Hydrologic Solutions, "StormChamber The Most Effective BMP!", Advertisement, Stormwater, Sep./Oct. 2002, p. 34.

Invisible Structures, Inc., "Total Stormwater Management", Advertisement, Stormwater, Sep./Oct. 2002, p. 35.

Tilton, Joseph Lynn, "Helping Stormwater Keep Its Place", Stormwater, Sep./Oct. 2002, pp. 40-41, 44-46, 48-49.

Contech Construction Products Inc., "Meet NPDES Requirements with CONTECH's Stormwater Treatment Train of Structural BMPs", Advertisement, Stormwater, Sep./Oct. 2002, pp. 42-43.

STORMTRAP, "Modular Storm Water Detention System", Advertisement, Stormwater, Sep./Oct. 2002, p. 47.

Mar-Mac Manufacturing, Inc., Advertisement, including photographs and drawings for assembly installed and completed near O'Hare Airport in 2001, 10 pages.

City of Chicago Department of Aviation, drawing of project installed at Midway Airport, Oct. 16, 2002, 1 page.

Illinois Department of Transportation, Standard 602101-01, Jan. 1, 1997, 1 page.

Illinois Department of Transportation, Standard 602006, Jan. 1, 1997, 1 page.

STORMTRAP drawings prepared by ECOCAST Ltd., for installation in Plainfield, IL, Aug. 1998, 9 pages.

STORMTRAP advertisements, StormTrap web site, Feb. 2002.

15F
15C
15E
15E
A
15C
B
15F 15C
11
15D
14A
A
3
2
1
7
5
8
1
4
6
15B
1
2
2
10
8
15E
9
B
10
15A

1
L
W
H
12
13H
13A
13A
13
13B
13C
13D
13D
4

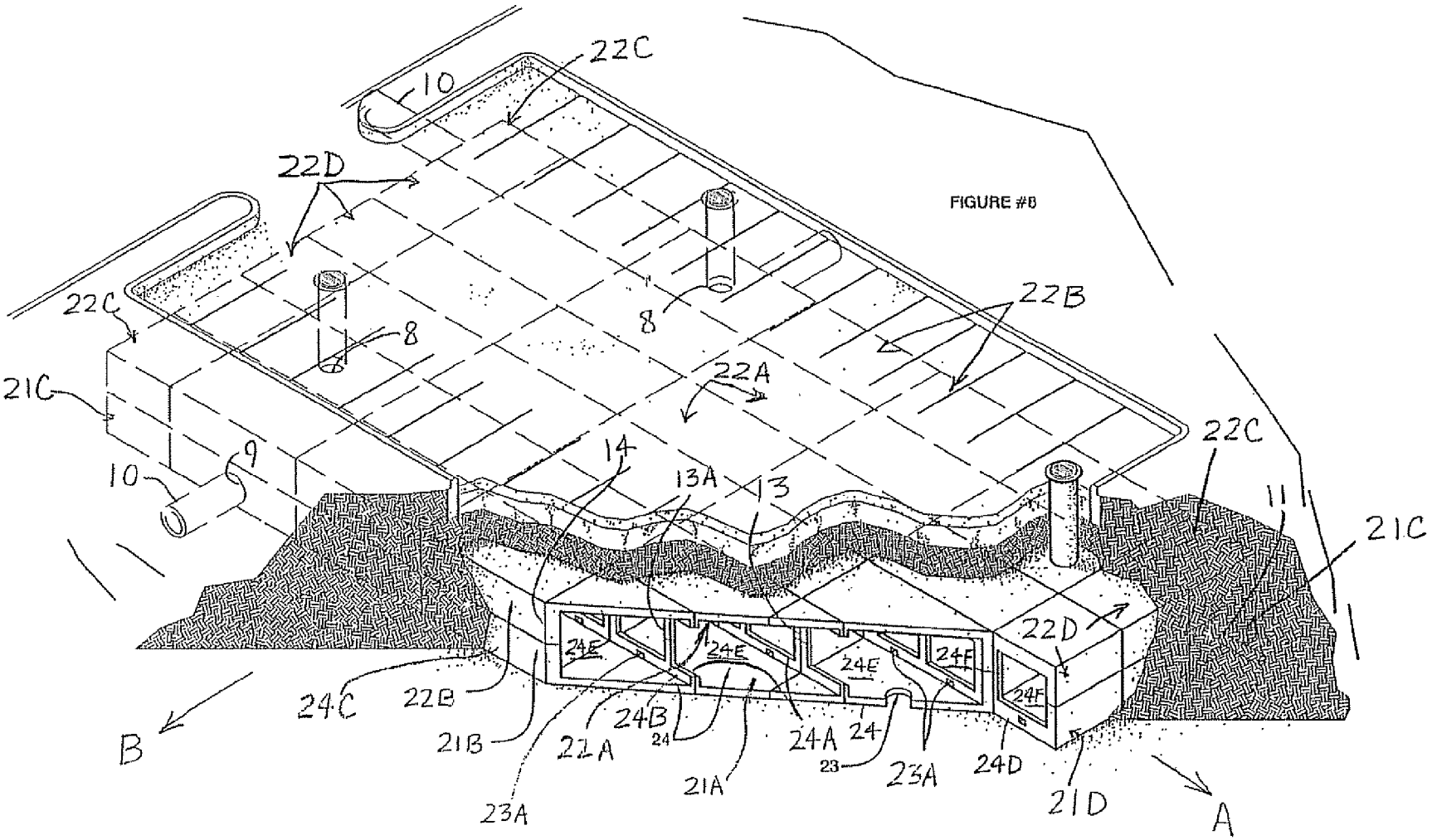
FIGURE #8

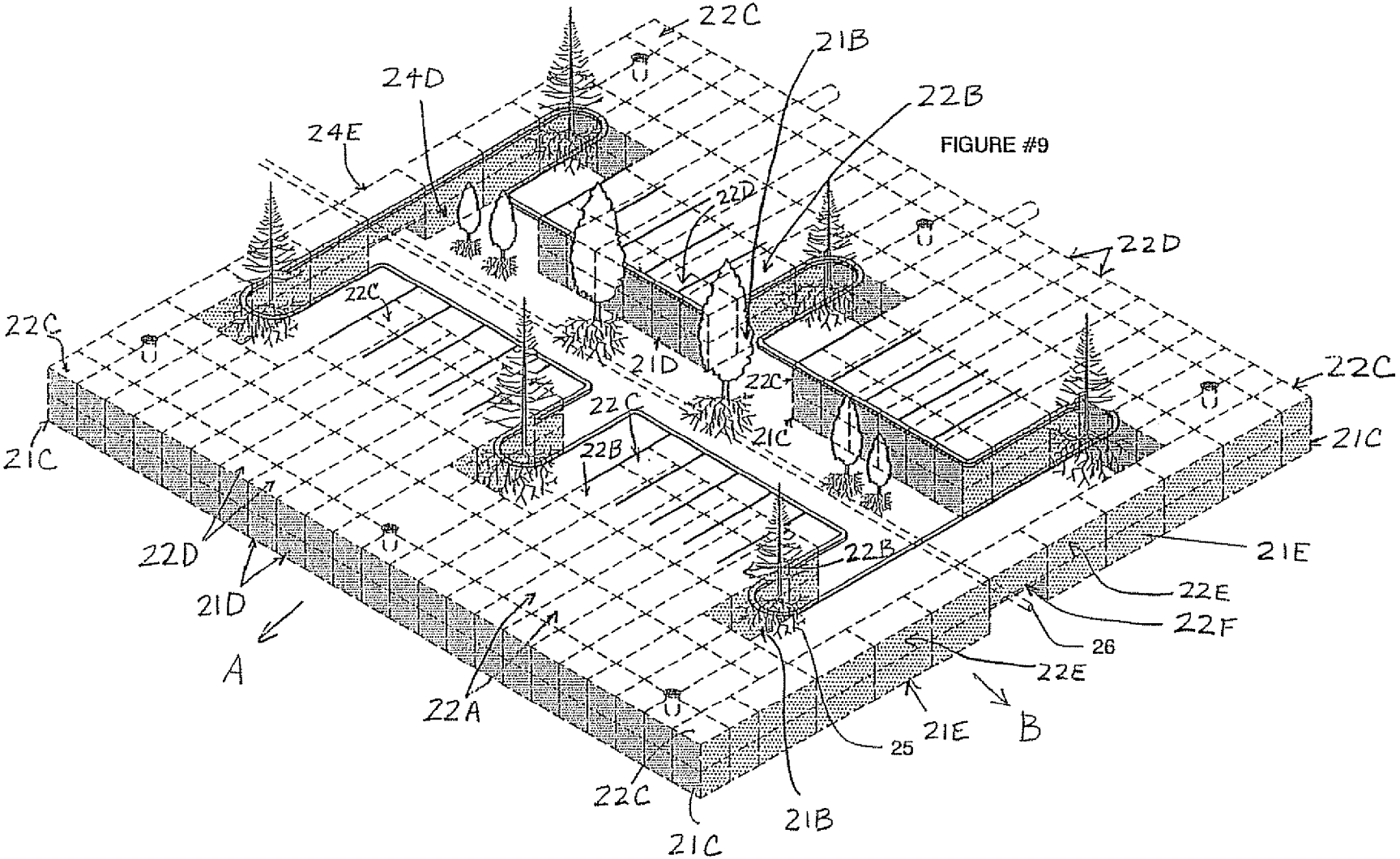
FIGURE #9

METHODS AND MODULES FOR AN UNDERGROUND ASSEMBLY FOR STORM WATER RETENTION OR DETENTION

CROSS REFERENCE TO RELATED APPLICATION

This application is a continuation application which claims priority to U.S. patent application Ser. No. 11/255,398, which was filed Oct. 21, 2005, now U.S. Pat. No. 7,160,058 which is a continuation application of U.S. patent application Ser. No. 10/272,851, which was filed Oct. 17, 2002, now issued U.S. Pat. No. 6,991,402, both of which are incorporated by reference herein.

BACKGROUND OF THE INVENTION

The present invention generally relates to the retention or detention of fluids, typically storm water, but may have other applications. Storm water retention and detention systems accommodate runoff at a given site by diverting or storing storm water and preventing pooling of water at the ground surface.

An underground storm water retention or detention system is generally utilized when the surface area on a building site is not available to accommodate other types of systems such as open reservoirs, basins or ponds. The underground systems do not utilize valuable surface areas as compared to reservoirs, basins or ponds. Underground systems are also advantageous in that they present fewer public hazards than other systems. Another advantage is that underground systems avoid having open, standing water which would be conducive to mosquito breeding. Underground systems also avoid the aesthetic problems of other systems such as algae growth and weed growth which can occur in other systems. Thus it is beneficial to have an underground system to manage storm water effectively.

One disadvantage of current underground systems is that they must accommodate existing or planned underground facilities such as utilities and other buried conduits. At the same time, the underground storm water retention or detention system must be effective in diverting storm water from the ground surface to another location. Therefore, it would be advantageous to provide a modular underground system which has great versatility in the plan area form it can assume.

Another disadvantage of current underground systems is that they do not provide unrestricted storm water flow throughout the system. So it is desirous to provide a system which can permit relatively unconstrained flow throughout the system.

Underground systems must be able to withstand the traffic and earth loads which are applied to it without being prone to failure. So it is advantageous to provide an underground system which accommodates virtually any application of a load applied at the ground surface in addition to the weight of the earth surrounding the system.

The present invention therefore relates to the configuration, production and use of modular sections, which are preferably precast concrete and are usually installed in a longitudinally and laterally aligned configuration to form underground channels for the retention and/or detention of storm water.

Different forms of underground storm water detention and/or retention structures have been either proposed or made, for example, as disclosed in U.S. Pat. No. 5,890,838 to Infiltrator Systems, Inc. of Old Saybrook, Conn. and marketed under the trade name the "Maximizer Chamber System." Furthermore, other underground water conveyance structures such as pipe, box culvert, and bridge culvert made of various materials have been proposed or constructed for underground storm water detention and/or retention purposes. However, the underground structures that have been previously proposed or constructed are designed for other applications and fail to provide one or more of the above advantages, as apparent after studying and analyzing their form.

SUMMARY OF THE INVENTION

The present invention is directed, in some of its several aspects, to a method and a module for use in a modular assembly for retaining or detaining storm water beneath a ground surface.

In one embodiment of the invention, a module comprises a substantially horizontally disposed deck portion and at least one substantially vertically disposed side portion extending therefrom. The deck portion and side portion have respective end edges, and the side portion has bottom edges. The side portion and the deck portion define a longitudinal channel which is open at least at one end of the module. The side portion has at least one opening therein which defines a lateral channel in the module. The longitudinal and lateral channels are in fluid communication with one another. Preferably, each channel has about the same cross section and extends upwardly from the bottom edges to allow relatively unconstrained fluid flow in the longitudinal and lateral directions.

The preferred module according to the present invention may be disposed in a single depth or level configuration, although other configurations are also possible and will be discussed. The module may be in the form of an inverted elongated U-shaped module or an inverted L-shaped module. A support member may be utilized in connection with the L-shaped modules to provide support to the assembly.

A plurality of modules may be assembled in any plan area configuration. The plurality of modules may define interior modules and side modules placed peripherally of the interior modules. Preferably, the modules are laterally and longitudinally aligned to form continuous channels which allow relatively unconstrained water flow within the assembly. One or more inlet ports allow influent into the assembly. If necessary, outlet ports, a perforated floor or a combination of both provide for fluid flow out of the assembly.

In another aspect of the invention, the modules may be assembled so that at least some of the modules are rotated relative to others. In one aspect, the modules may be assembled into a double depth configuration where the U-shaped modules are placed within the ground in an upright manner with the deck portion forming a floor to the assembly. Inverted U-shaped modules may then be placed in vertical alignment above the inverted modules. This assembly forms upper and lower levels of modules with each level of modules having longitudinally and laterally aligned channels. The lower modules are preferably rotated 180° relative to the upper modules so that one level of modules is inverted relative to the other level.

A method of retaining or detaining storm water includes the steps of connecting the longitudinal and lateral channels such that the channels are aligned and in fluid communication with one another and placing an outer boundary around the channels.

DETAILED DESCRIPTION OF THE DRAWINGS

FIG. 1 is a perspective view of a first embodiment of an underground installation of a modular assembly constructed for retaining and/or detaining storm water under an automobile parking lot with a portion of the assembly cut away to show the interior illustrating seven individual module embodiments.

FIG. 1*a* is a plan view of a second embodiment of a modular assembly.

Figure 4:
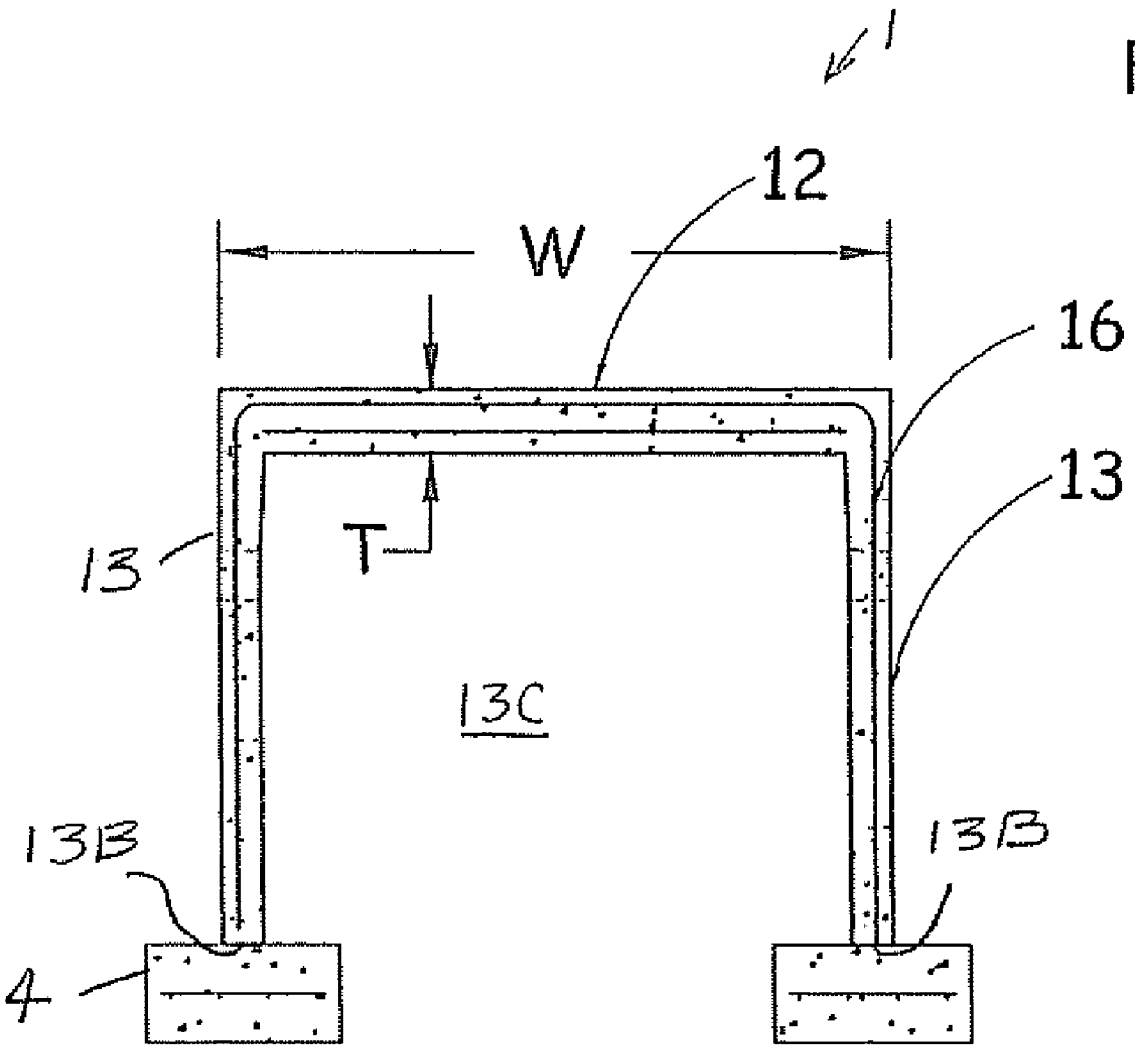
Figure 4B:
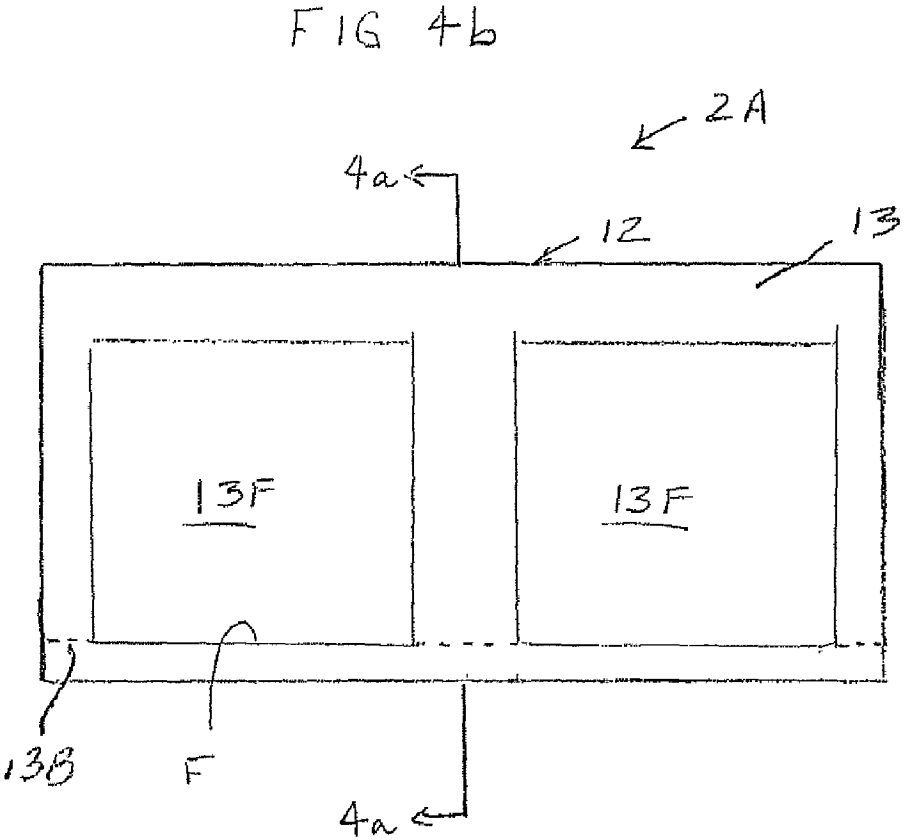
Figure 4A:
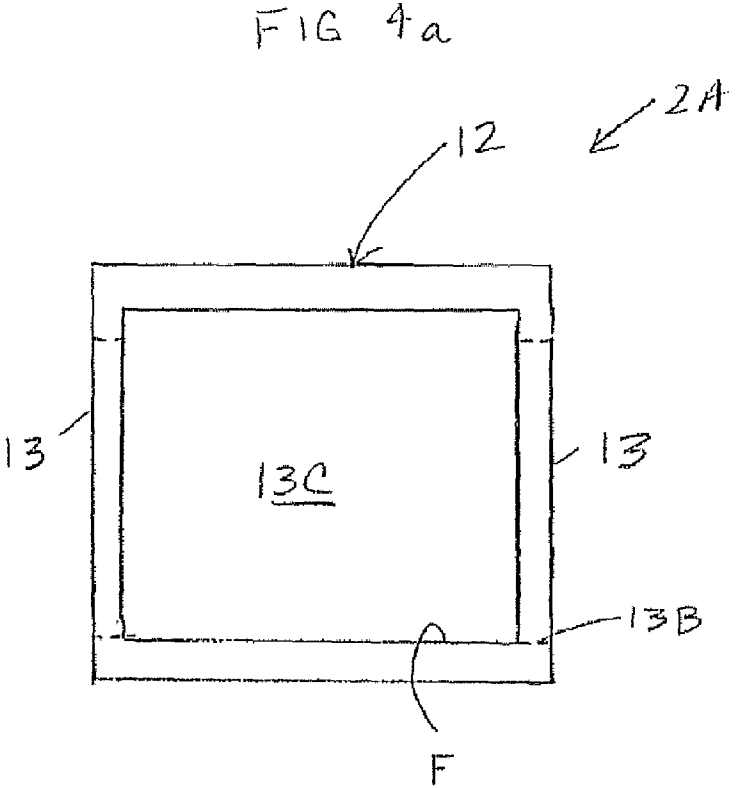

FIG. 4*a* is a vertical cross-sectional view taken along the line indicted in FIG. 4*b*.

FIG. 4*b* is an elevation side view of a modified module including a floor.

Figure 5:
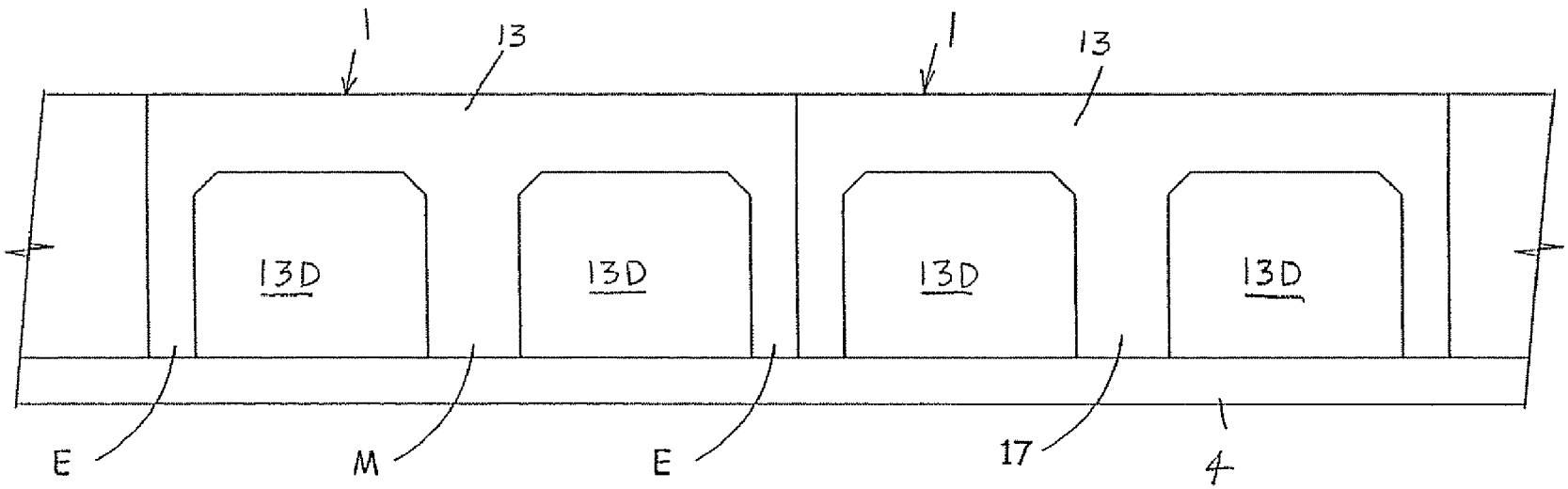

FIG. 5 is an elevation side view of a series of interior modules assembled and connected.

Figure 6:
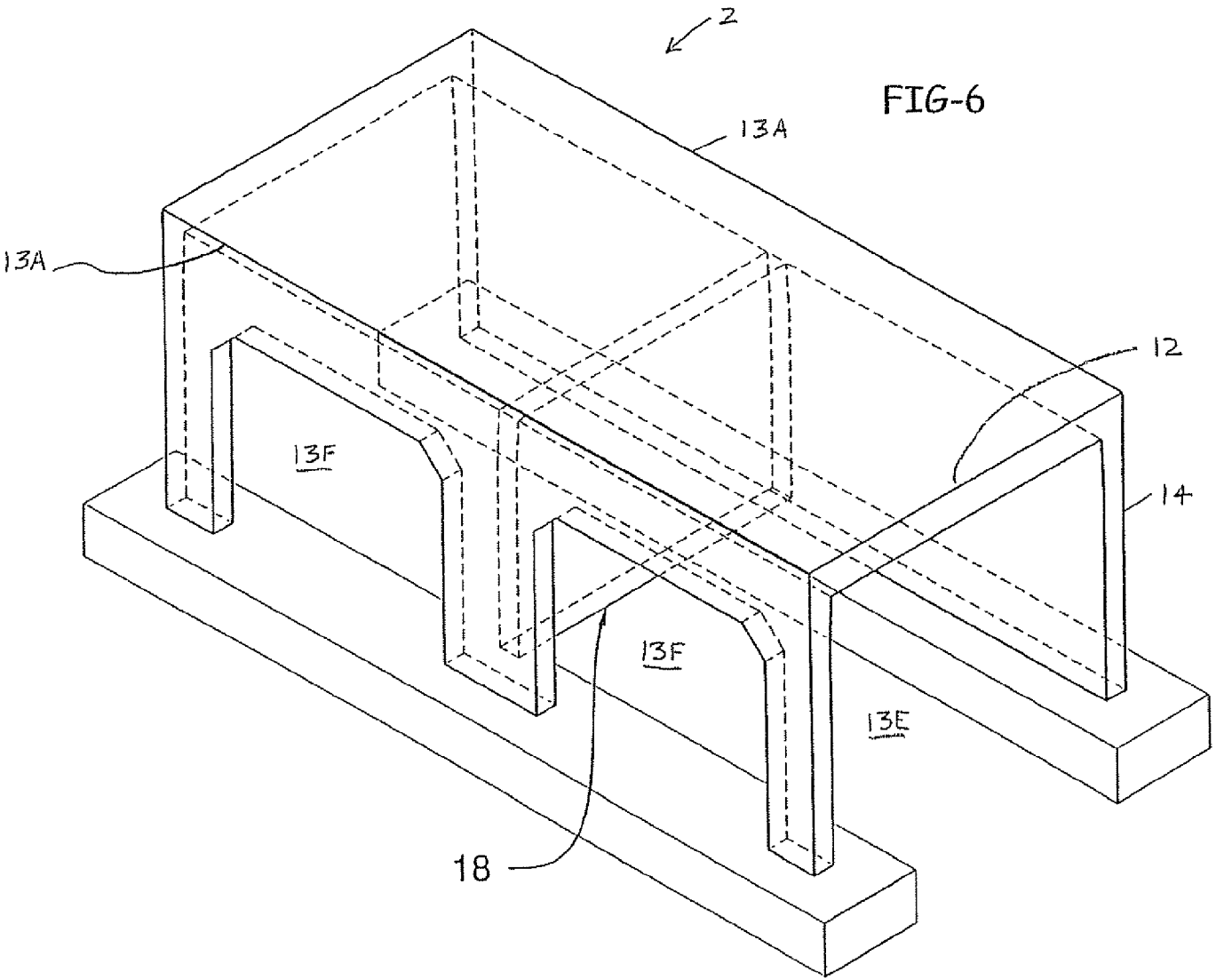

FIG. 6 is a perspective view of a module with an integral structural brace or reinforcement.

Figure 7:
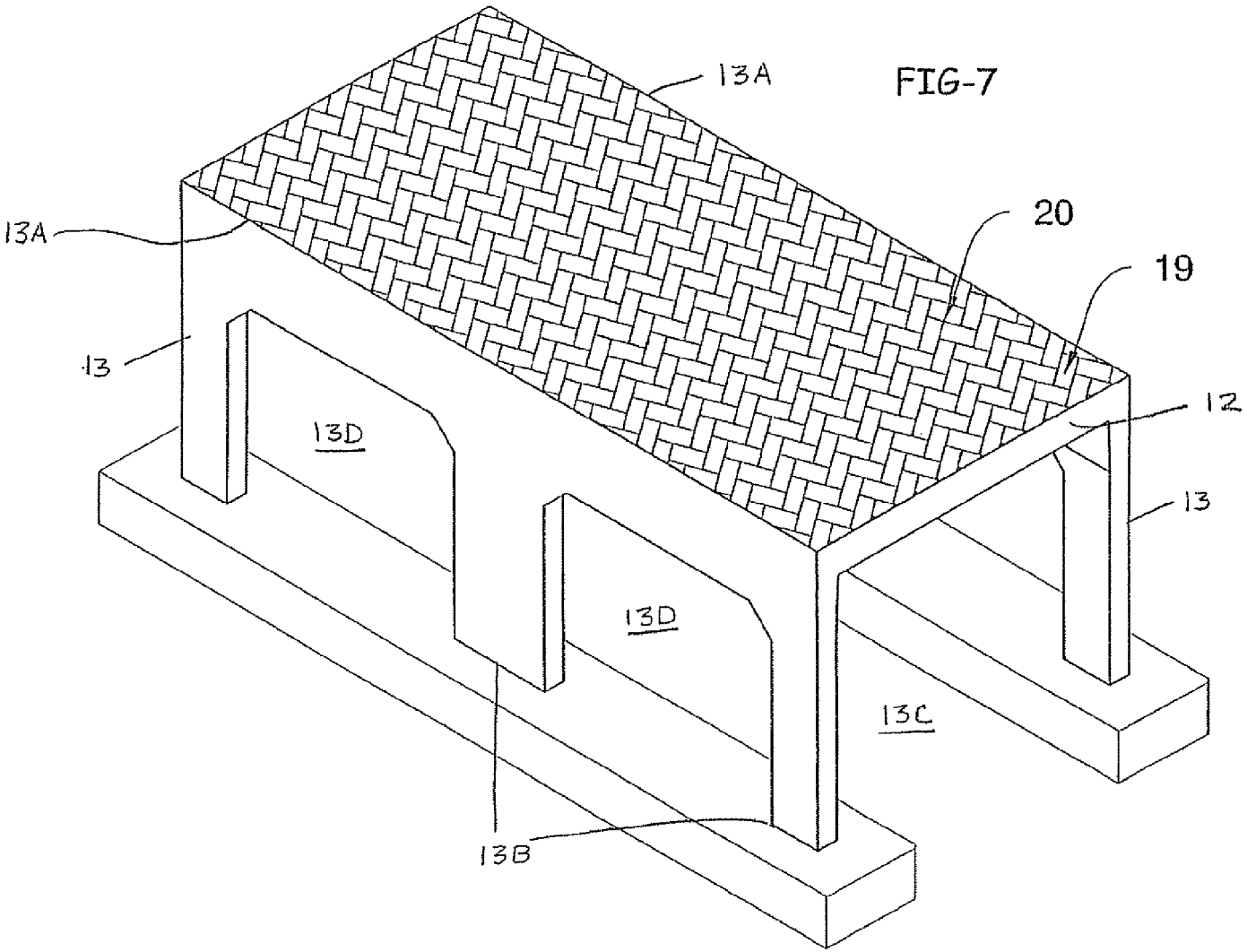

FIG. 7 is a perspective view of a seventh embodiment of a module illustrating a traffic surface.

FIG. 8 is a perspective view with a corner cut away of a third embodiment of an underground assembly illustrating a double depth configuration which shows two levels of modules stacked on top of one another.

FIG. 9 is a perspective view of an alternate embodiment of an underground installation assembly demonstrating the assembly's versatility to fit constraints of a site and underground obstacles.

Figures 1, 2, 4:
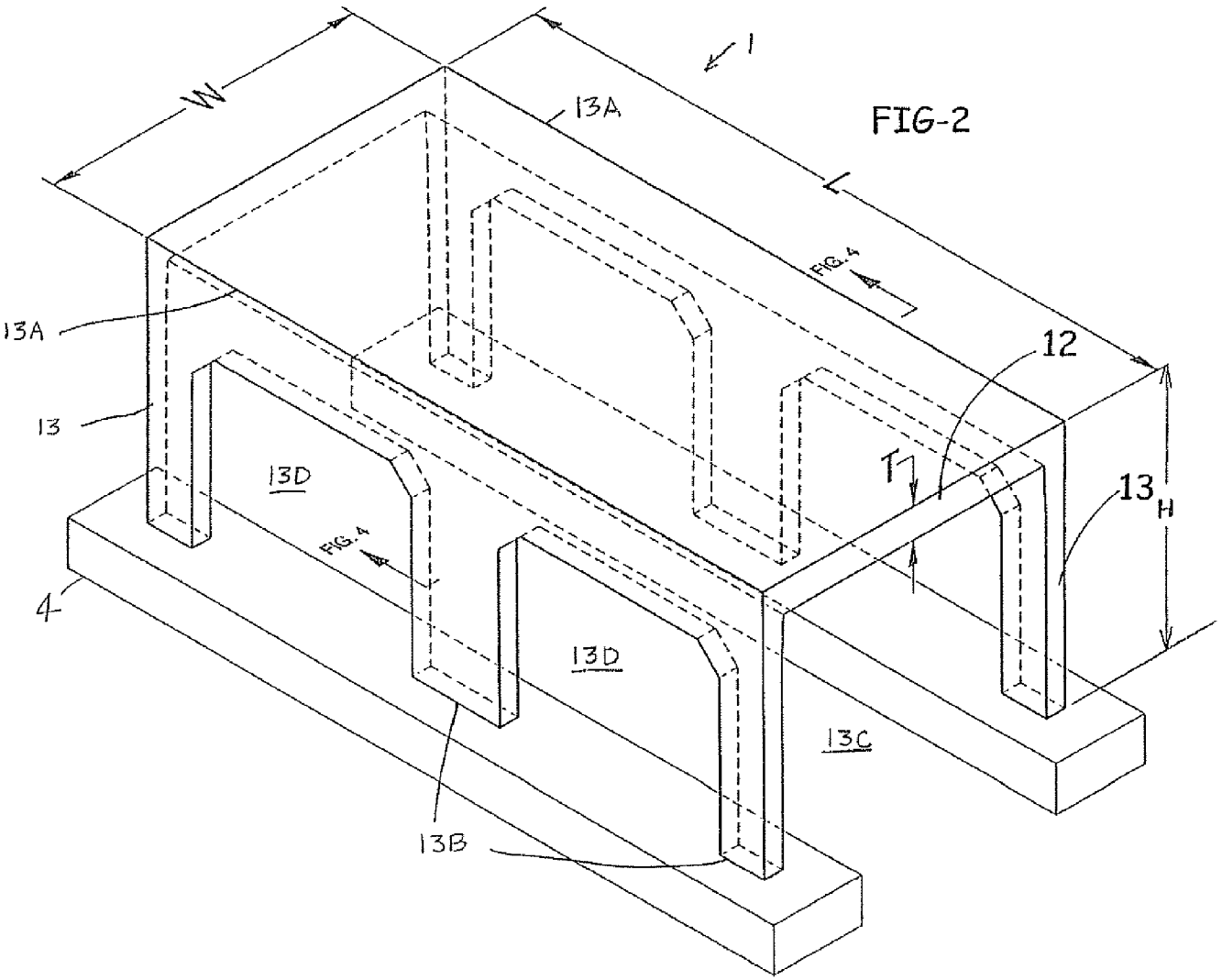
FIG. 2 is a perspective view of a first embodiment of a module shown in FIG. 1.
FIG. 4 is a vertical cross-sectional view taken along the line indicted in FIG. 2.
Figure 10A:
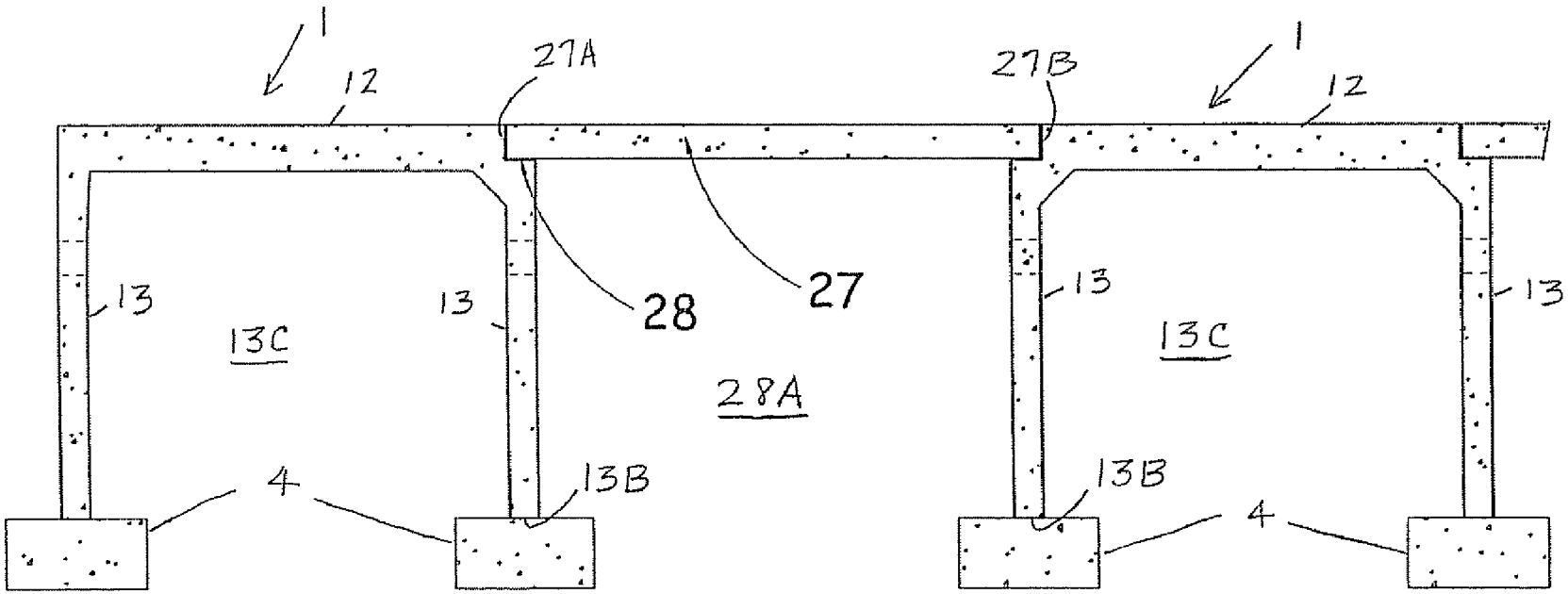

FIG. 10*a* is a vertical, cross-sectional view, similar to FIG. 4, except that it shows a group of modules in a spaced apart configuration and shows a connecting portion extending between two modules where the ends of the connecting portion are received within recesses of the module deck portions.

Figure 10B:
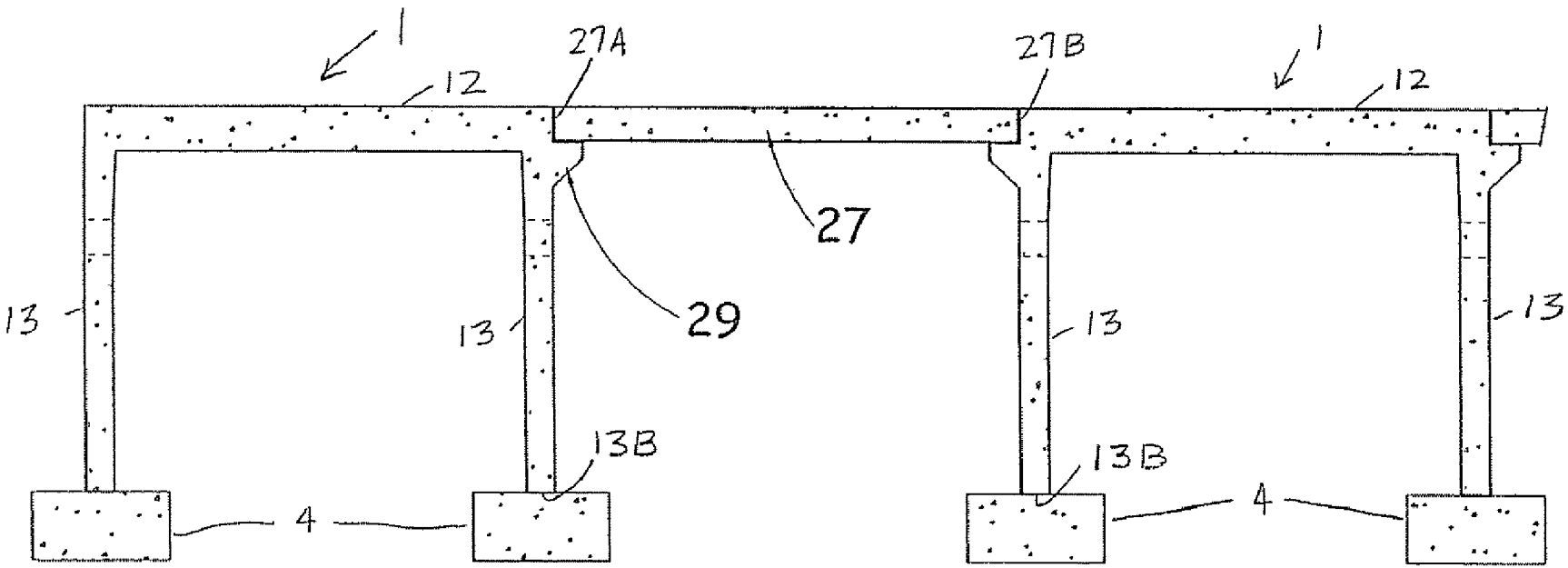

FIG. 10*b* is a view, similar to FIG. 10*a*, illustrating another modification where the connecting portion is supported by ledges.

Figure 10C:
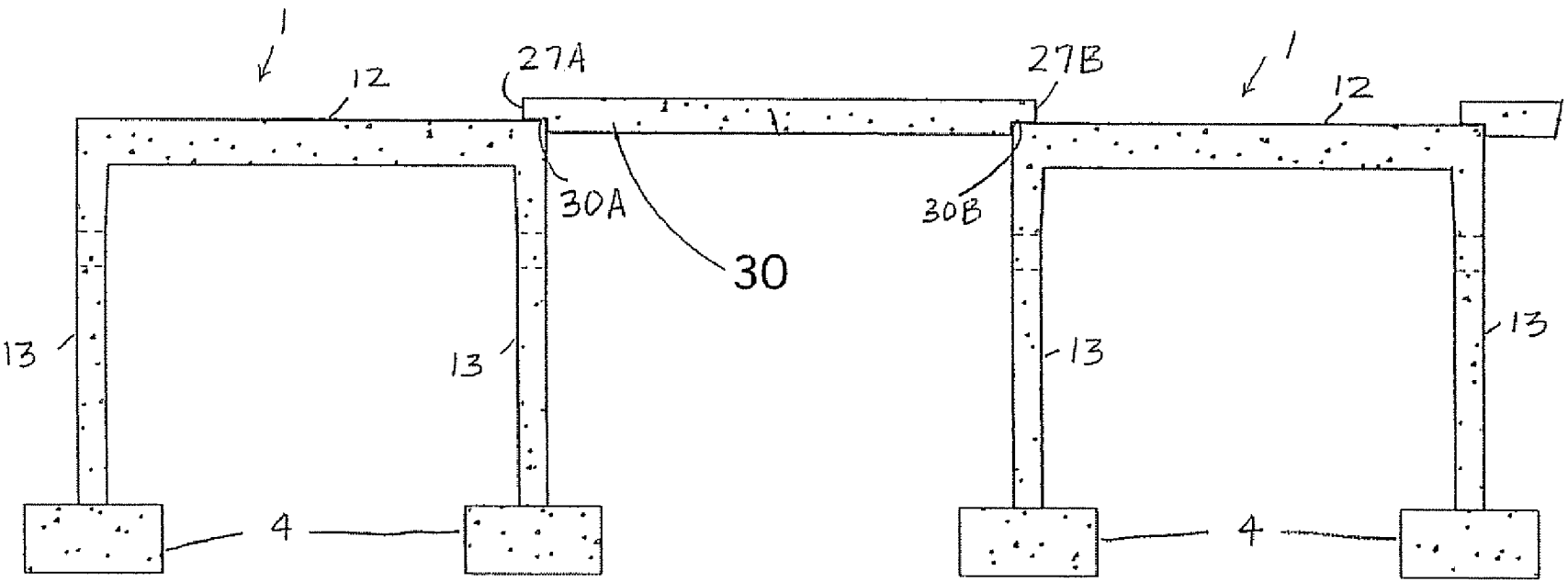

FIG. 10*c* is a view, similar to FIG. 10*a*, illustrating a modified connecting portion which includes depressions formed in its lower surface.

Figure 11A:
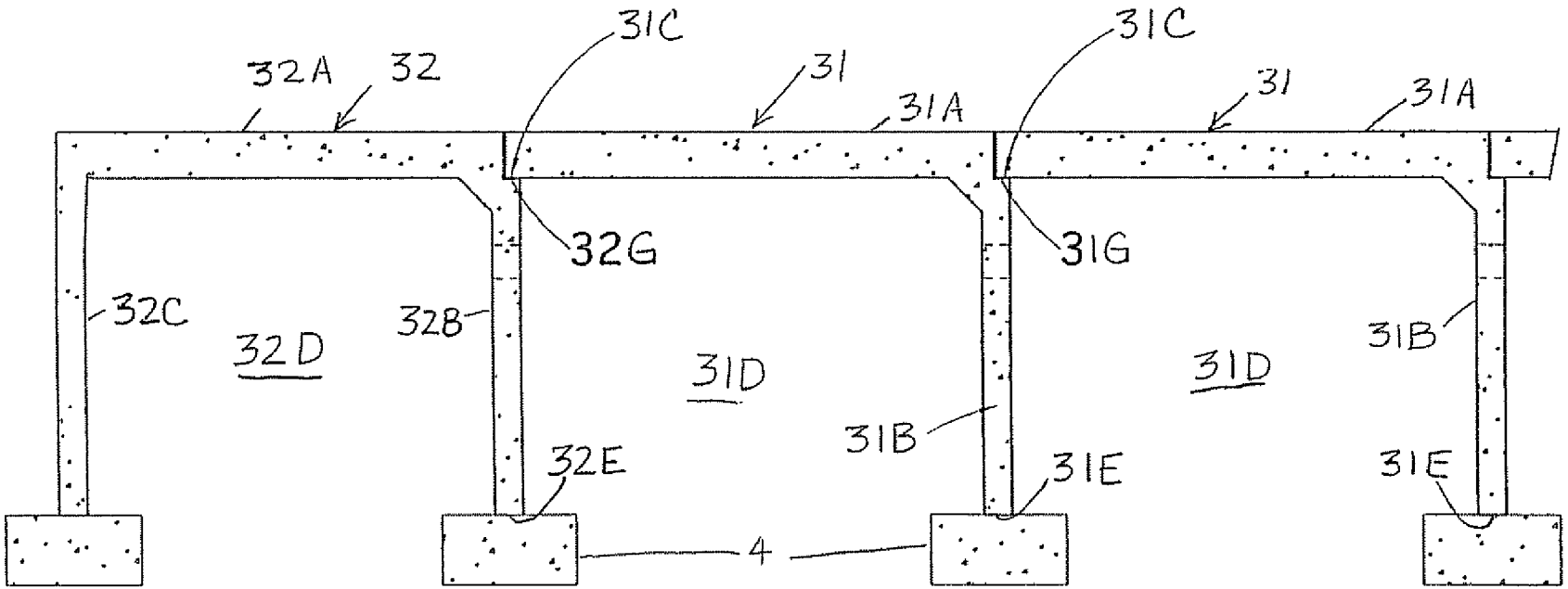

FIG. 11*a* is vertical, cross-sectional view, similar to FIG. 4, except that it shows a group of modules according to various features of an eighth embodiment of a module.

Figure 11B:
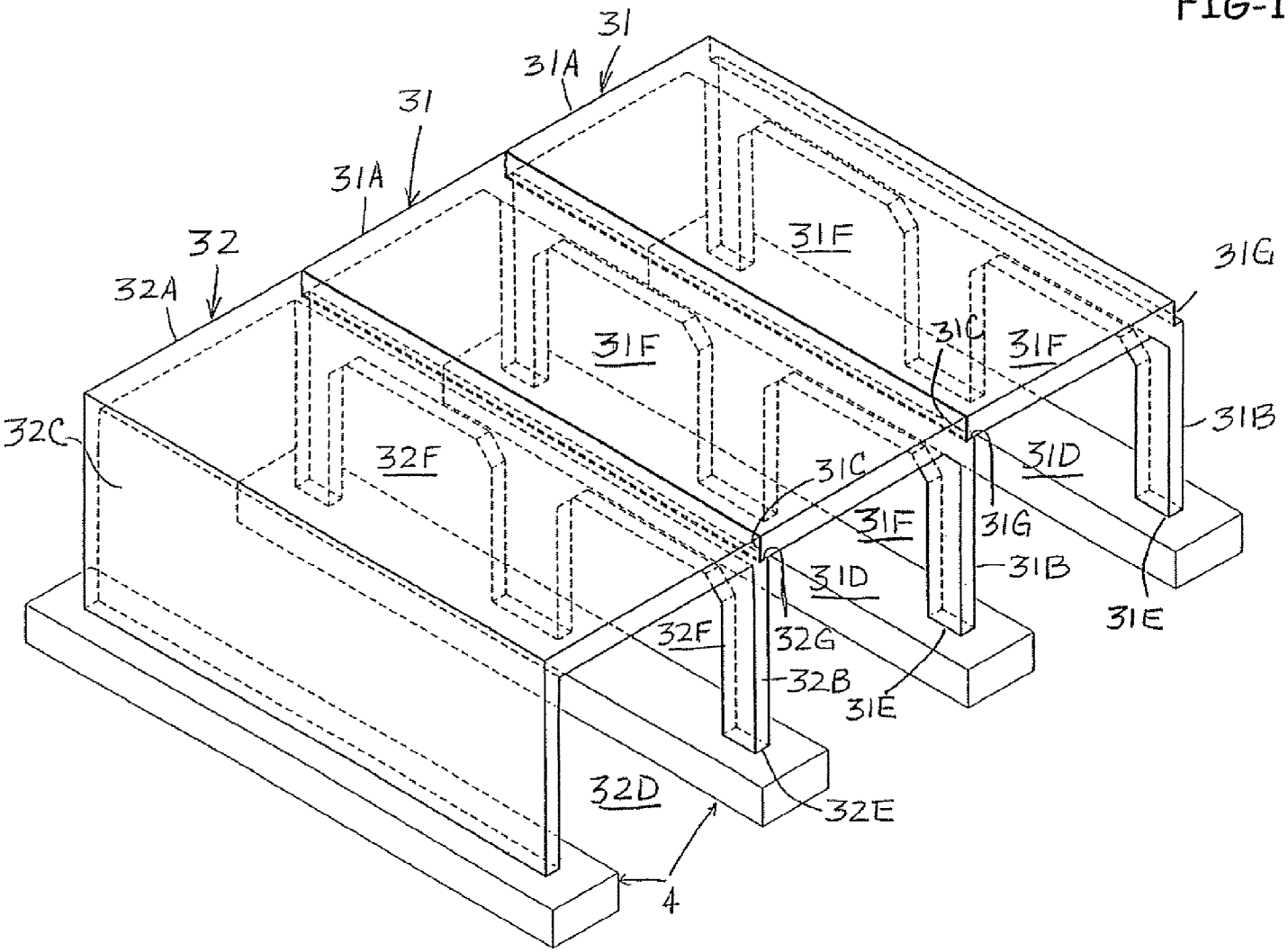

FIG. 11*b* is a perspective view of the assembly of FIG. 11*a*.

Figure 11C:
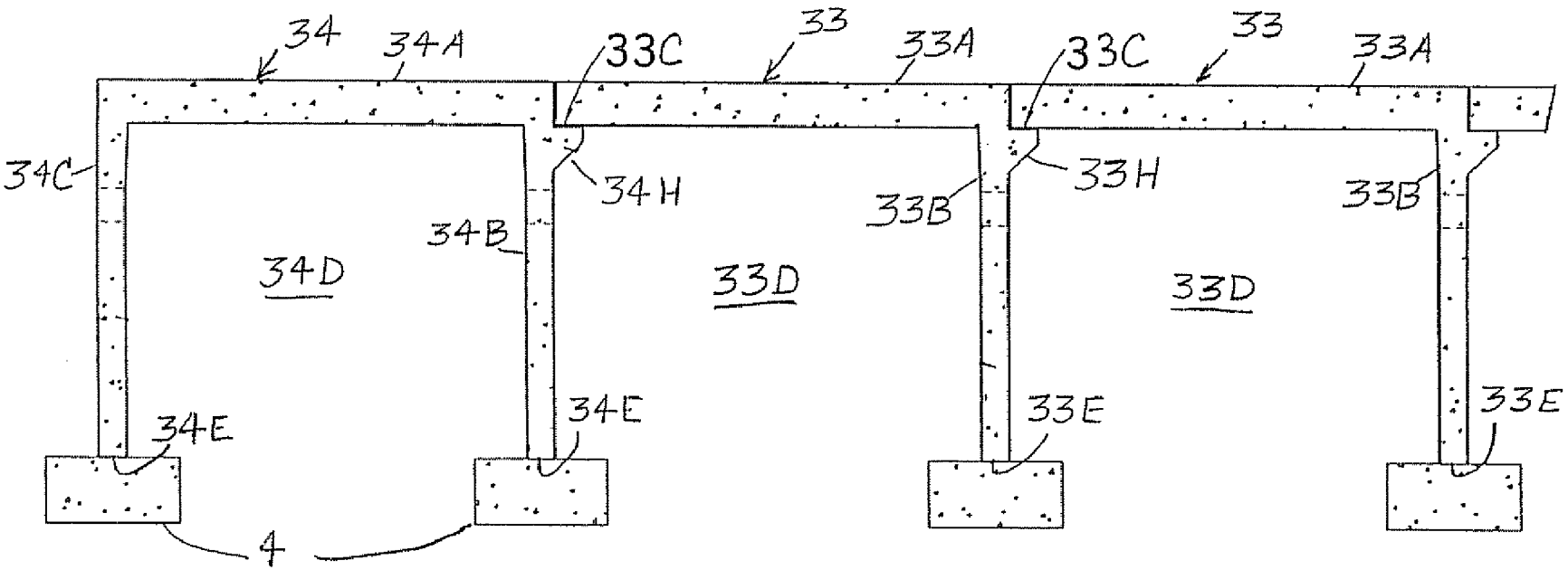

FIG. 11*c* is a view similar to FIG. 11*a*, which illustrates another modification utilizing ledges to support adjacent modules.

Figure 12A:
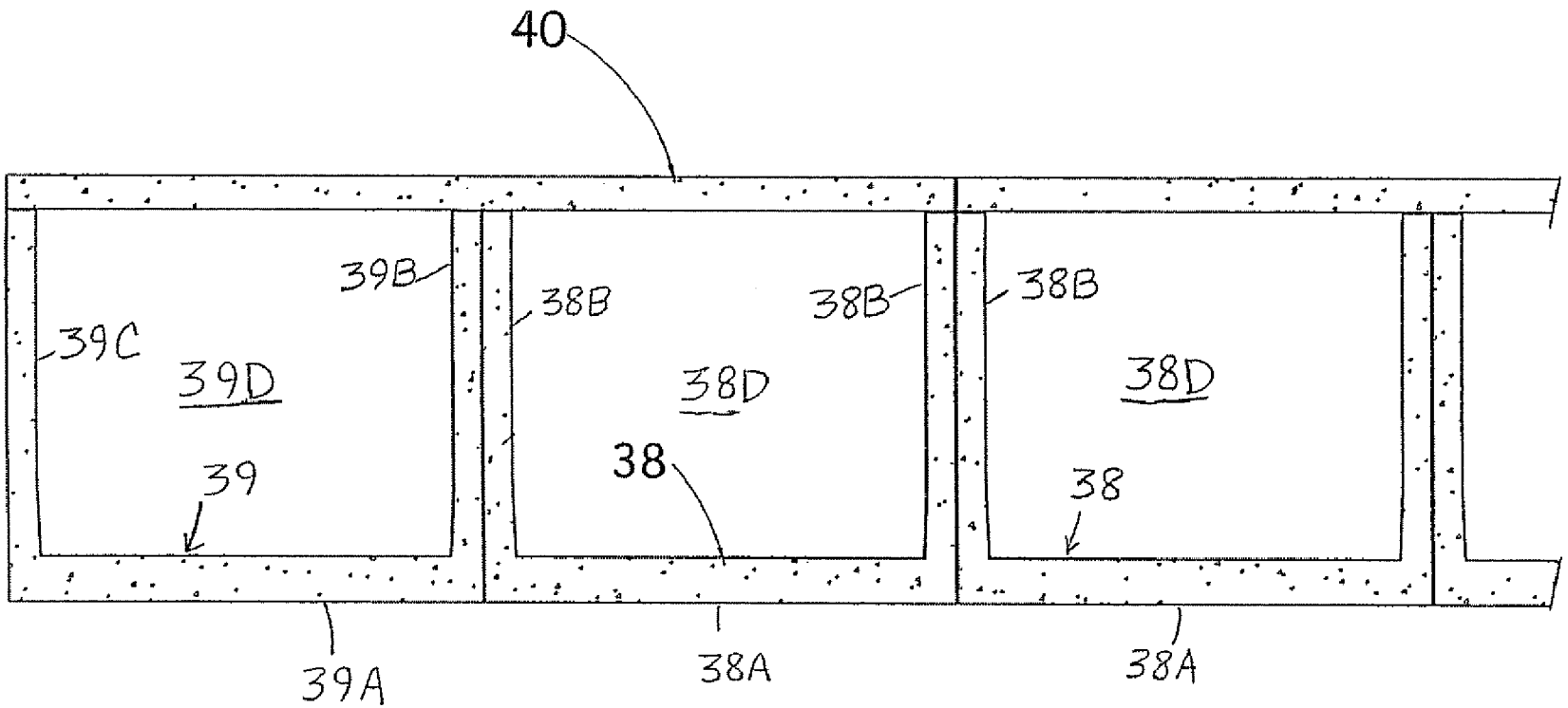

FIG. 12*a* is a vertical, cross-sectional view, similar to FIG. 4, except that it shows upright U-shaped modules in conjunction with a top deck in accordance with a ninth embodiment of a module.

Figure 12B:
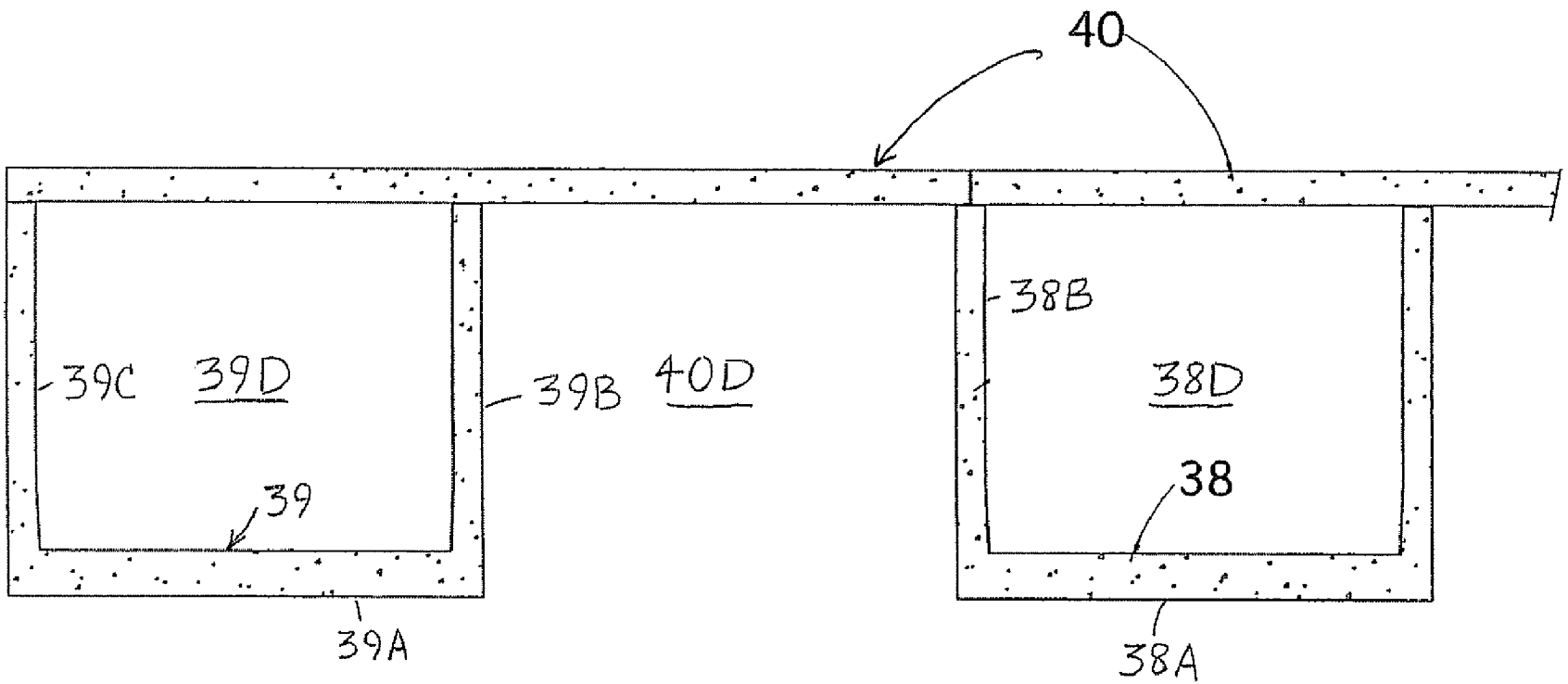

FIG. 12*b* is a view, similar to FIG. 12*a*, except the modules are oriented in a laterally spaced apart configuration.

Figure 13A:
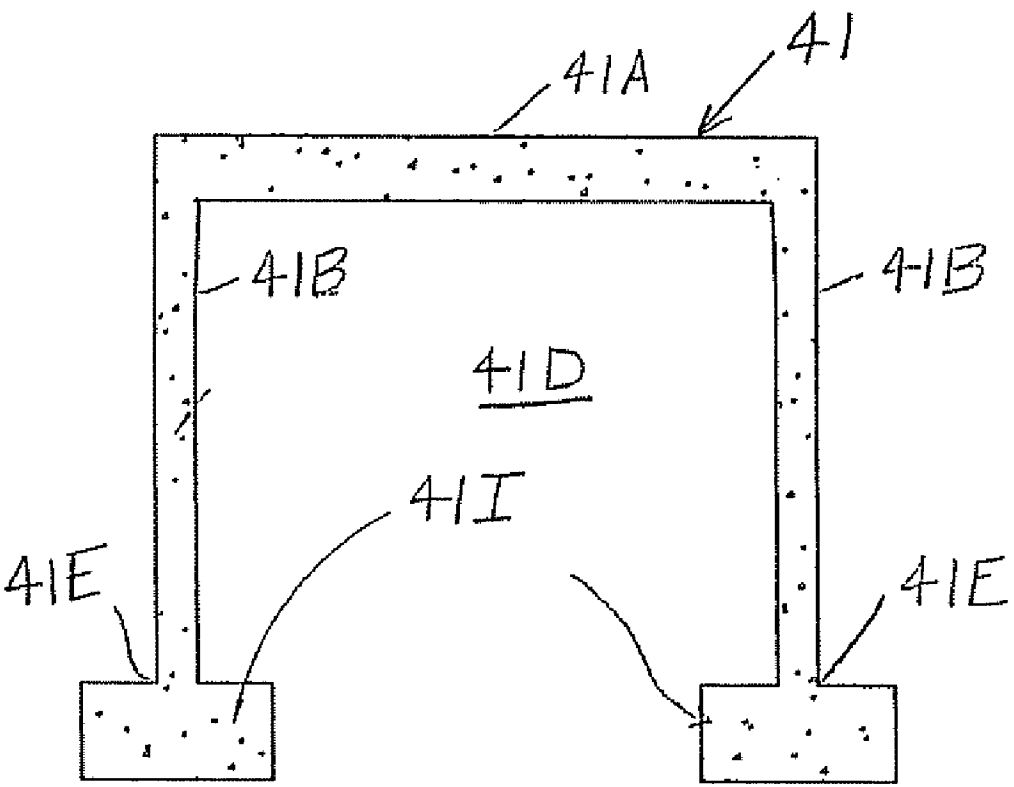

FIG. 13*a* is a vertical, cross-sectional view, similar to FIG. 4, except that it is formed with integral footings or pads at the bottom of the side portions.

Figure 13B:
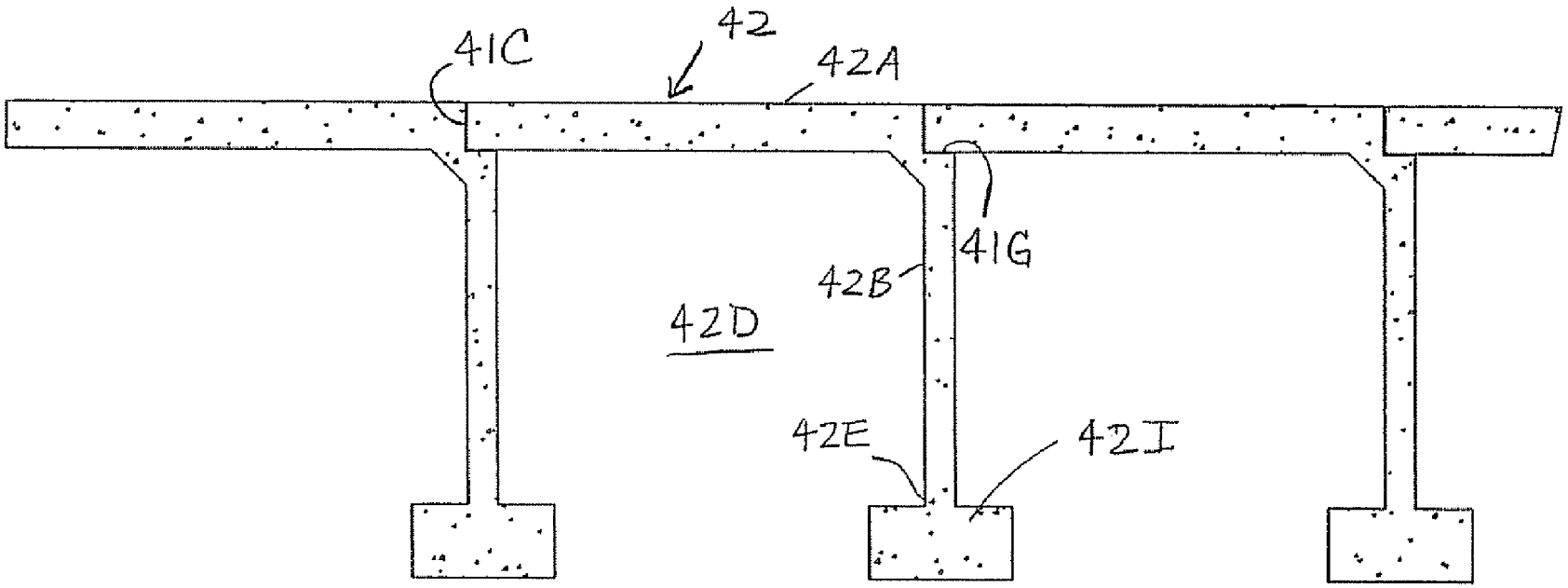

FIG. 13*b* is a view, similar to FIG. 11*a*, except that it is formed with integral footings or pads at the bottom of the side portions.

Figure 13C:
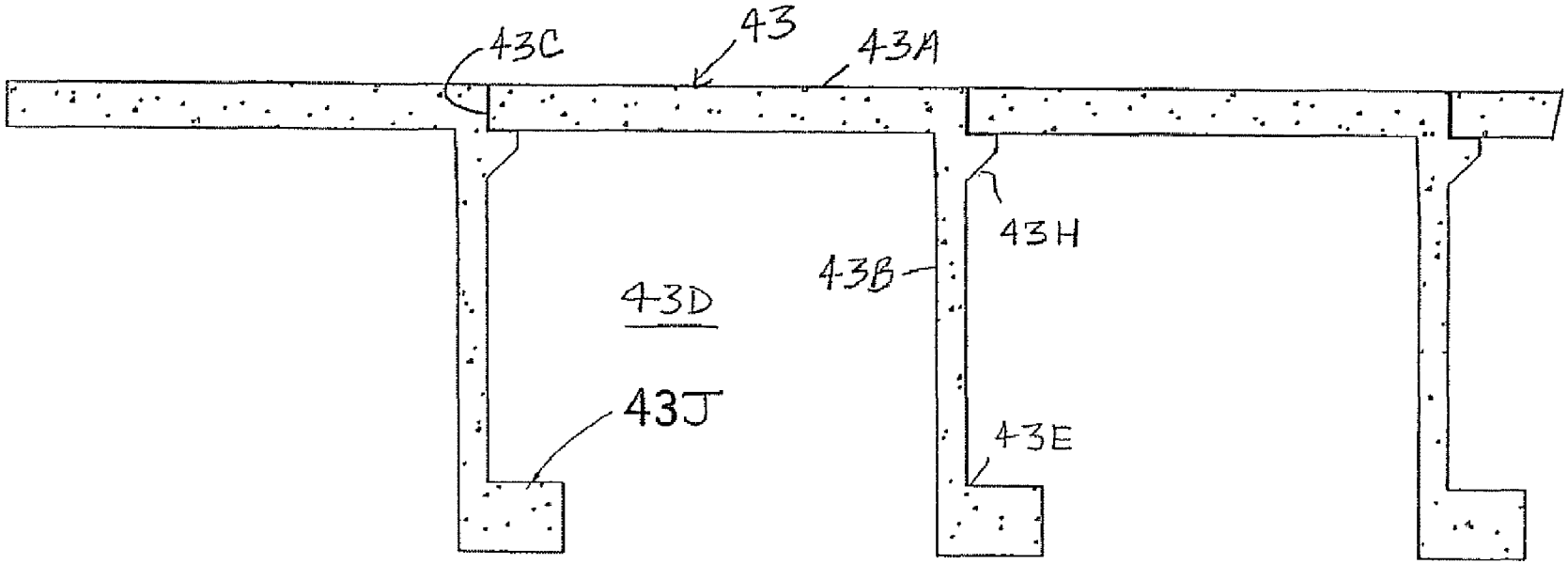

FIG. 13*c* is a view, similar to FIG. 11*c*, except that it is formed with integral footings or pads at the bottom of the side portions.

Figure 13D:
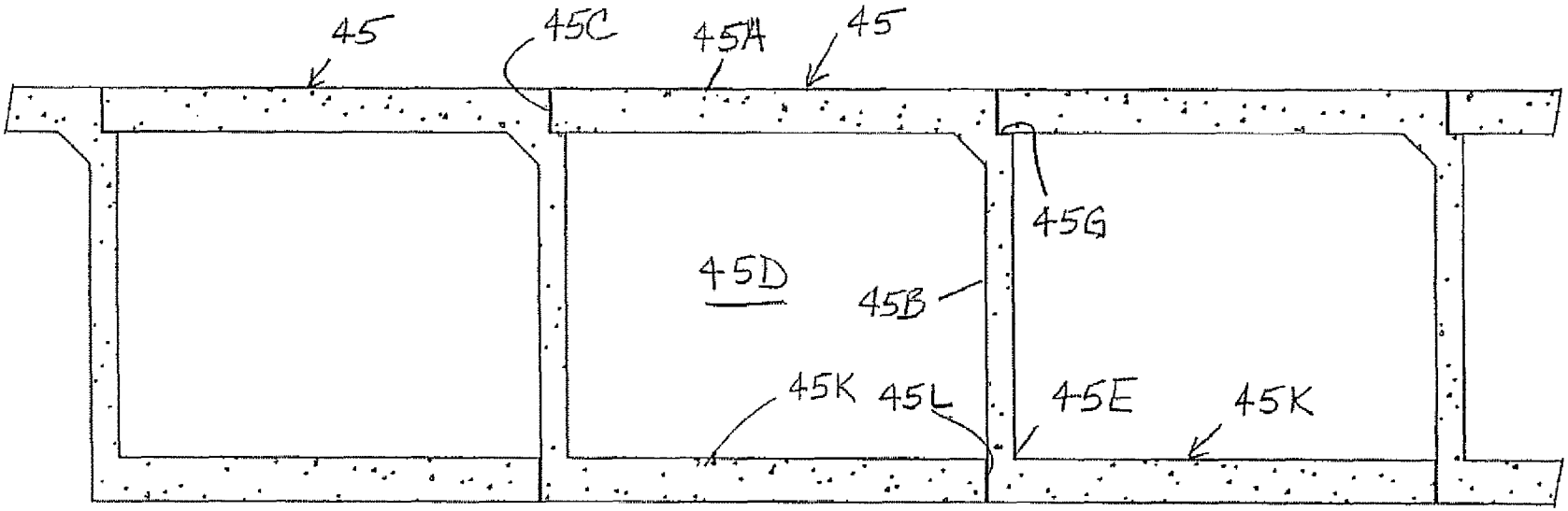

FIG. 13*d* is a view, similar to FIG. 11*a*, except that it is formed with an integral floor at the bottom of the side portions.

Figure 13E:
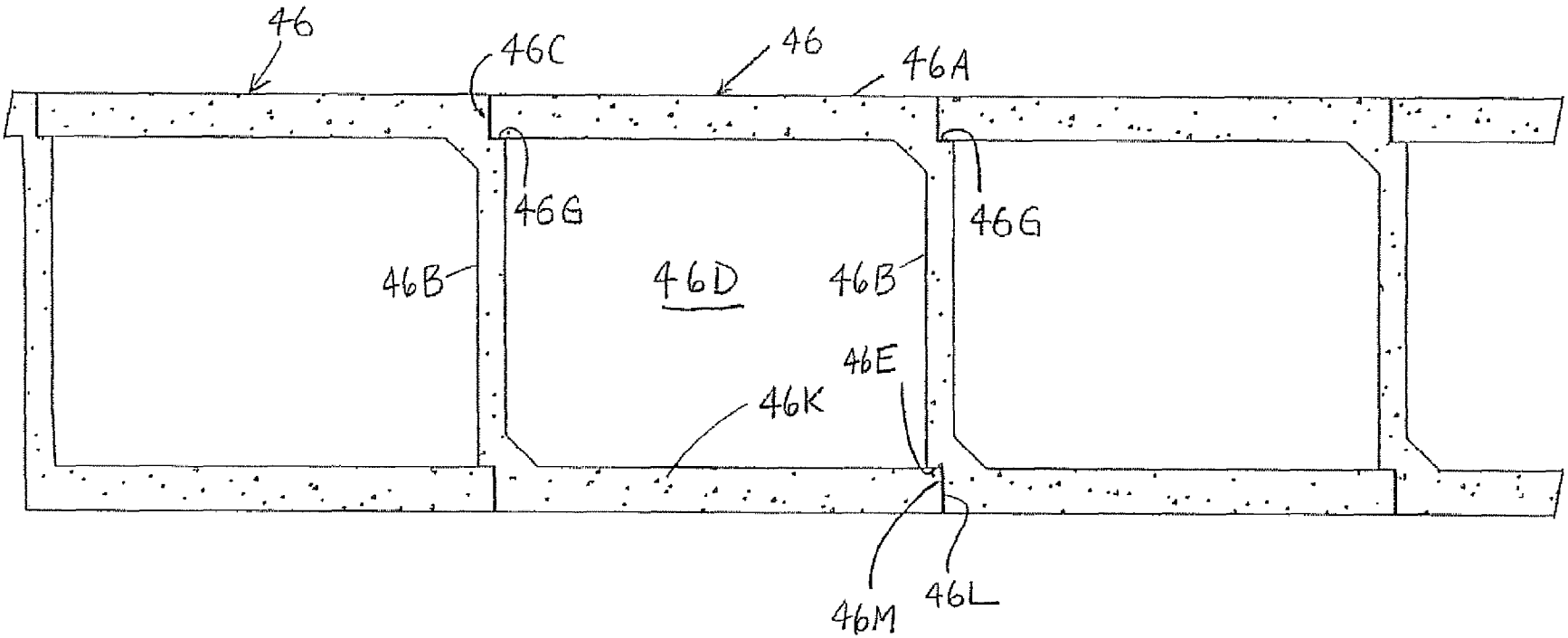

FIG. 13*e* is a view, similar to FIG. 13*d*, except that it includes a recess at the bottom of the side portion to receive the free end of an adjacent floor.

Figure 13F:
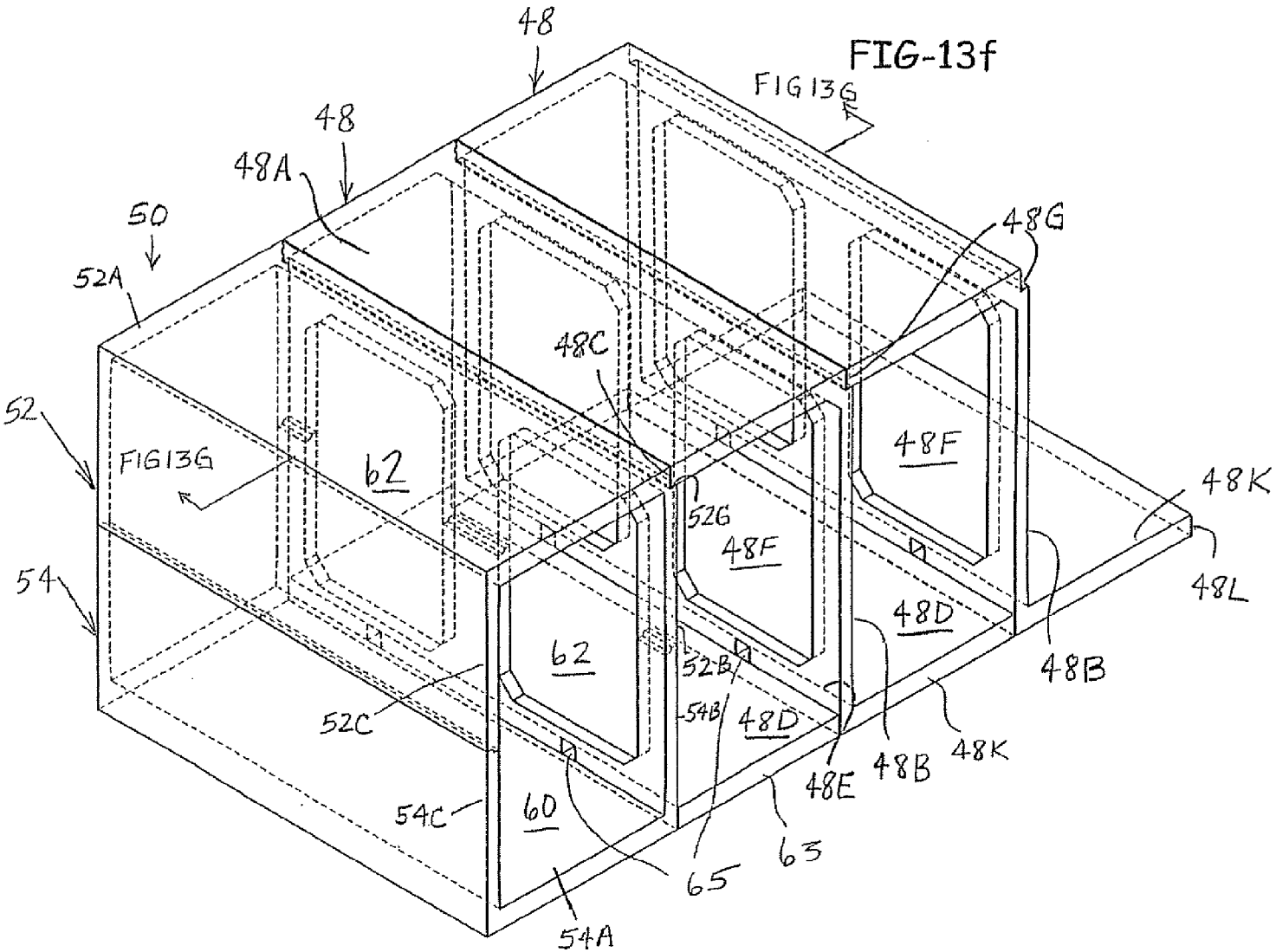

FIG. 13*f* is a perspective view showing a group of modules according to various features of a tenth embodiment having a double depth configuration.

Figure 13G:
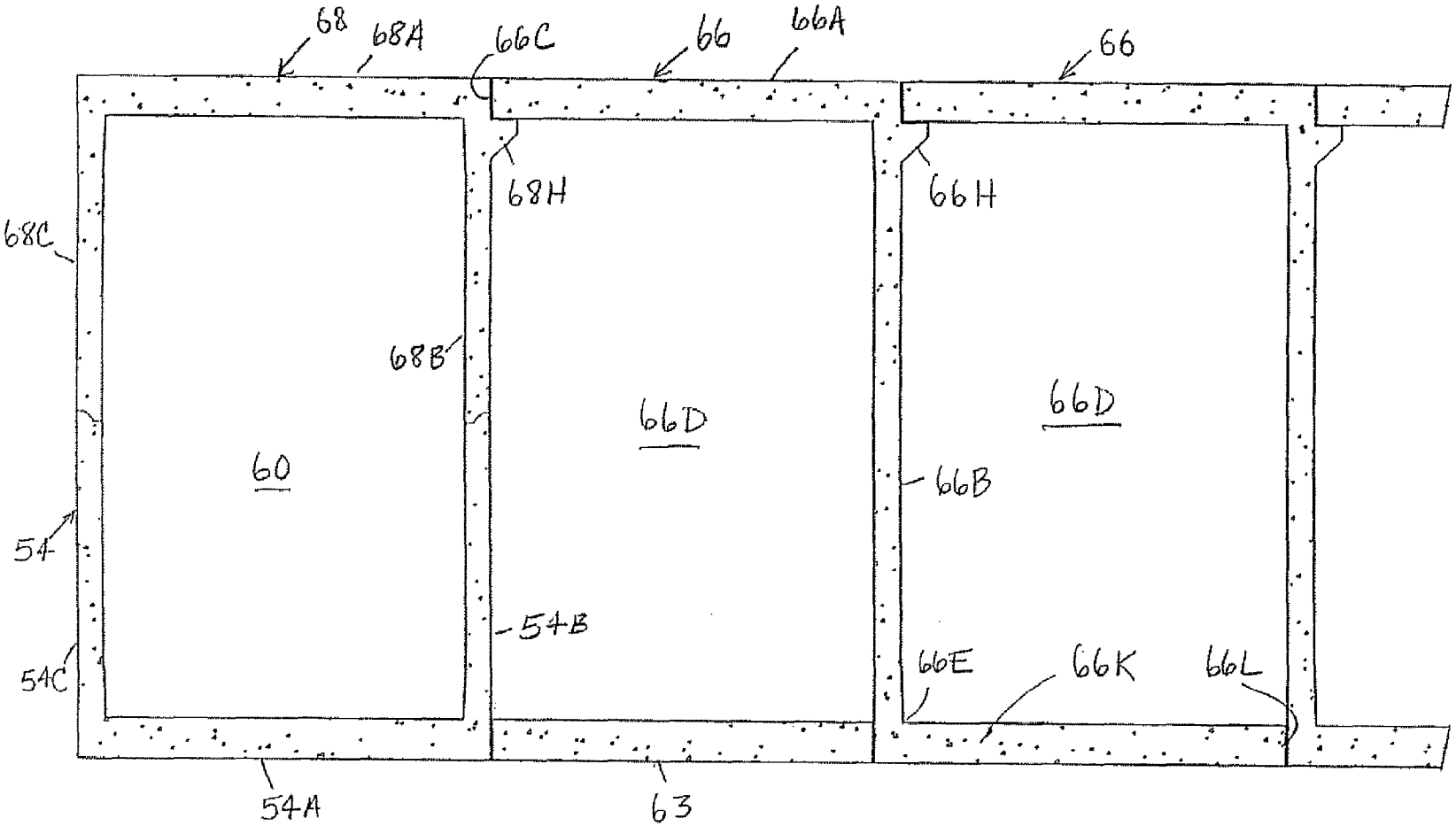

FIG. 13*g* is an end view of an assembly, similar to FIG. 13*f*, except that the assembly includes ledges supporting adjacent modules instead of recesses.

Figure 13H:
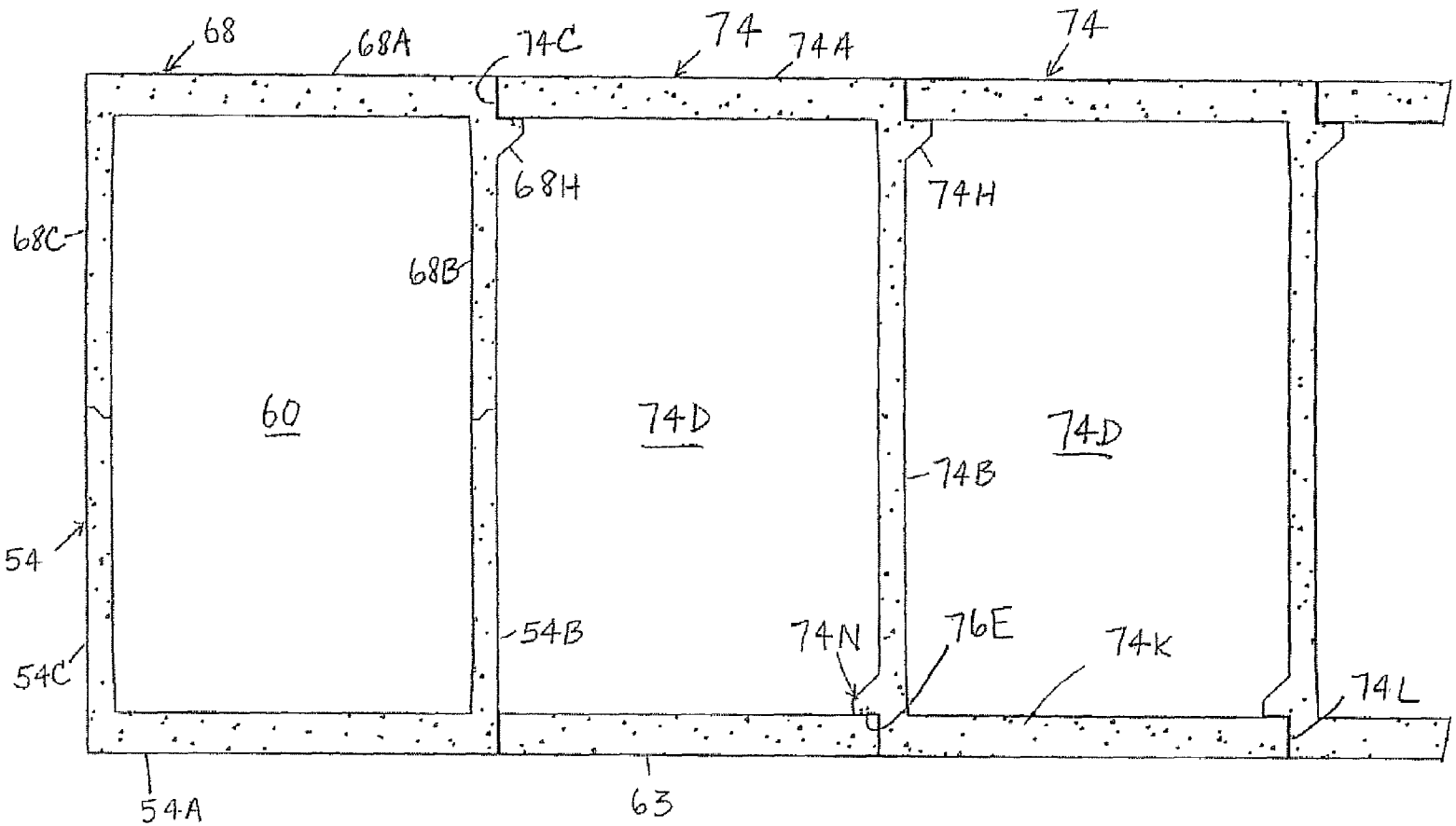

FIG. 13*h* is a view, similar to FIG. 13*g*, except that it includes a ledge spaced from the bottom of the side portion to locate the free end of an adjacent floor.

DETAILED DESCRIPTION OF THE PREFERRED EMBODIMENTS

The present invention generally provides a module for an underground assembly for storm water retention as well as storm water detention. In one aspect of the invention, these modules provide great versatility in the configuration of a modular assembly. The modules may be assembled in any customized orientation to suit any plan area or footprint as desired by the particular application involved and its side boundaries. The modular assembly may be configured to avoid existing underground obstructions such as utilities, pipelines, storage tanks, wells, and any other formations as desired. The modules for use in the present invention are sold by Utility Concrete Products, LLC of Plainfield, Ill. or by its related company, StormTrap LLC of Morris, Ill., under the trademark StormTrap™.

The modules are positioned in the ground at any desired depth. For example, the topmost portion of the modules may be positioned so as to form a traffic surface such as, for example, a parking lot, airport runway or tarmac. Alternatively, the modules may be positioned within the ground underneath one or more earth layers. In either case, the modules are sufficient to withstand earth, wheel, or object loads. The modules are suitable for numerous applications, and, by way of example but not limitation, may be located under lawns, parkways, parking lots, roadways, airports, railroads, or building floor areas. So it can be seen that the preferred modules give ample versatility for virtually any application while still permitting storm water retention or detention.

In another aspect of the invention, the module permits storm water to be stored within its interior volume which is defined by longitudinal and lateral channels that will be described in detail below. The channels are generally defined by a deck portion and at least one side portion. Both the longitudinal and lateral channels extend upwardly from the bottom edge of the module so as to allow relatively unconstrained storm water flow in both the longitudinal and lateral directions of the modules of the preferred embodiment. Preferably, these channels occupy a relatively large proportion of the area of the module. The module design permits a large amount of internal storm water storage while minimizing the excavation required during site installation and minimizing the plan area or footprint occupied by each module.

In addition, the modules may be further configured either in a single level or single depth, or alternatively, they may be configured in what is called a double depth whereby at least two modules are combined, preferably in vertical alignment relative to each other. In a double depth configuration, a lower module preferably has an upright U-shape so that the deck portion now forms a floor. An upper module which preferably has an inverted U-shape is stacked upright on the lower module. In other words, one of the upper and lower modules is preferably inverted approximately 180° relative to the other of the upper and lower modules. The side portions of the upper module are vertically aligned with the side portions of the lower module. The individual longitudinal and lateral channels formed by each of the upper and lower modules thereafter form portions of larger channels which have an increased depth. So it can be seen therefore that the double depth configuration further increases the interior volume of the assembly.

Assembly inlet ports permit storm water into the modules from areas outside of the assembly such as, for example, water accumulating at the ground level or other water storage areas located either at ground level or other levels. These inlet ports can be located at any elevation in order to permit fluid communication with existing storm water drains and conduits. The water can either be stored within the assembly or be permitted to exit the assembly using one or more passageways. Assembly outlet ports may be used to direct the storm water to one or more of the following offsite locations: a waterway, water treatment plants, another municipal treatment facility or other locations which are capable of receiving storm water. Another way that storm water may exit the assembly is through the process of water percolation through a perforate assembly floor. Other ways will be apparent to one skilled in the art.

Figures 1, 1A:
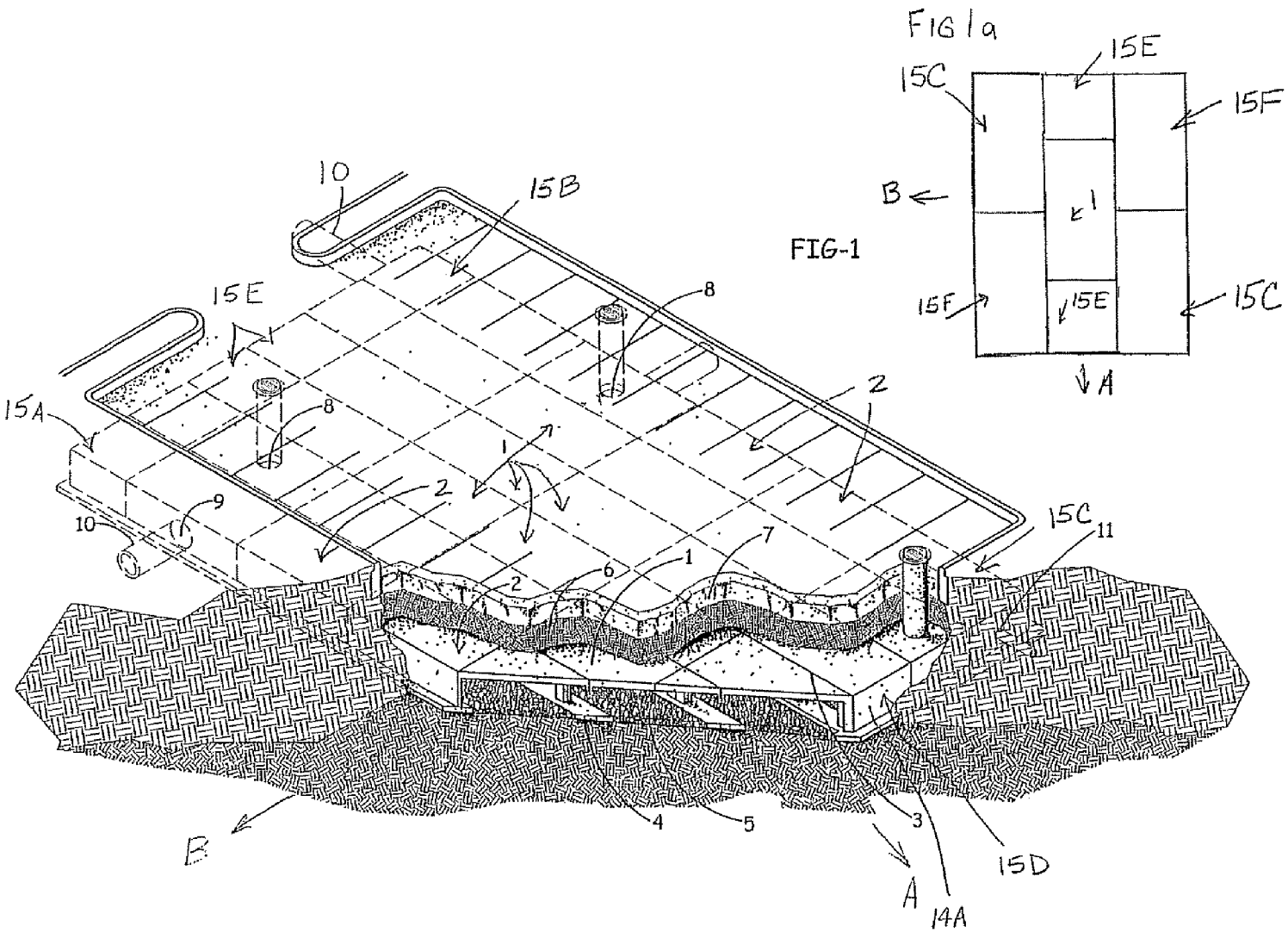

FIG. 1 illustrates a first embodiment of an underground assembly for storm water retention and/or detention. The assembly of FIG. 1 is composed of a plurality of modules, such as interior modules, generally indicated at 1, and perimeter or side modules, generally indicated at 2. Each module will be described in more detail below. In FIG. 1 assemblies of modules are preferably placed in side-by-side and end-to-end configuration beneath a ground surface although the modules may also be spaced apart, as described below. Joints 3 between the modules are typically sealed with a sealant or tape such as, for example, bitmastic tape, wraps, filter fabric or the like. The length or width of the assembly of modules forming the channel is unlimited and may form irregular shapes such as the assembly illustrated in FIG. 9, which will also be described in detail.

In FIG. 1, the modules are preferably placed on footings or pads 4 which are positioned in a parallel and spaced orientation. The footings 4 may be precast or formed in-situ and are preferably made of concrete. The gap between the footings is preferably filled with aggregate material or filter fabric material 5 allowing all or a portion of the storm water to be absorbed by the soil. The aggregate or fabric material 5 is preferably placed between the footings 4 and extends approximately to the top surface of the footings so that it forms a flat layer for the channel bottom surfaces. The aggregate material may comprise any conventional material having a suitable particle size which allows the storm water to percolate into the earth layers beneath the assembly at whatever flow rate is desired. Various filter fabrics may also be used. Alternatively, the area between the footings may be filed with continuous in-situ concrete or a membrane forming a floor. The floor may be impervious except for an assembly outlet port, which will be described below.

As shown in FIG. 1, the assembled modules are covered with compacted soil 6 and/or road materials 7 to support a non-traffic area, traffic area, building floor or other areas. FIG. 1 generally illustrates a single depth configuration. Inflow of storm water to the assembly illustrated in FIG. 1 may occur via one or multiple assembly inlet ports 8. Each port is fluidly connected to a ground level drain and its associated conduit. While the inlet ports 8 are shown in the given orientation of FIG. 1, these inlet ports are not limited to particular locations. Rather, they may be specifically customized as required by the preferred site requirements to allow for the direct inlet of the storm water into the assembly. For example, the location of these ports may be preformed during the formation of the module if the preferred location is known, or, on the other hand, the ports may be formed during installation using appropriate tools.

Another inflow source that may be used, either alone or in combination with the inlet ports, are one or more side inlet ports 9. These may be placed in customized locations and elevations in the perimeter walls to receive storm water via pipes 10 from remote locations of the site. FIG. 1 shows one side inlet port 9, but multiple such ports may be provided. Assembly outlet ports 11 may be placed in various locations and at various elevations in the perimeter walls of the channel for outlets of the storm water. By way of example, but not limitation, in FIG. 1, one outlet port 11 preferably is used and is sized generally smaller than the inlet ports to restrict the flow of storm water exiting the assembly.

FIGS. 2 and 4 illustrate a first embodiment of a module and, in particular, show the interior module 1 of FIG. 1 in greater detail. The interior module 1 includes a substantially horizontally disposed deck portion 12 located overhead (in this figure) and two substantially vertically disposed side portions 13. The side portions 13 extend downwardly from longitudinal side edges 13A of the deck portion 12 and provide support to the deck portion. The side portion 13 includes bottom edges 13B which preferably rest on the footing 4 at the bottom of the assembly. Although not shown in FIGS. 2 and 4, the gap between the footings 4 is preferably filled with an aggregate material 5, as seen in FIG. 1, which extends to the top surface of the footings. Instead of footings, the bottom edges 13B of the side portion 13 may rest on a floor which extends between the bottom edges. The floor may be imperforate, or it may have one or more openings, as later shown and described in FIG. 8, in order to allow controlled access of storm water out of the module.

The preferred module has a longitudinal channel and at least one lateral channel. As shown in FIGS. 2 and 4, in the interior module 1, the deck portion 12 and the side portions 13 define a longitudinal channel 13C which is open at the ends of the module. The longitudinal channel extends upwardly from the bottom edges 13B of the side portions 13. The longitudinal channel 13C extends in the longitudinal direction of the module to permit storm water flow in that direction. In the embodiment illustrated, each side portion 13 has two openings which are disposed in a side-by-side orientation, and these openings define two lateral channels 13D. The lateral channels 13D also extend upwardly from the bottom edges 13B and permit storm water flow in a lateral direction of the module.

Both the longitudinal channel 13C and the lateral channels 13D are in fluid communication with one another so as to permit storm water flow in the longitudinal and lateral directions. It is noted that the flow between the longitudinal and lateral channel occurs relatively unconstrained within the module due to the size and location of the channels. Each of the channels extends to the bottom edge 13B of the side portion 13 and thus to the bottom surface or floor of the module. As best seen in FIG. 1, the channel bottom surfaces for both the longitudinal channel and the lateral channels are formed by the footings 4 and the aggregate material 5. So even very low water levels are permitted to flow between channels.

Both longitudinal and lateral channels are quite large so as to allow such unrestricted flow. They range in height from approximately one foot to five feet or more. The channel sizes also prevent clogging due to roadside debris which may enter the modules. While it is preferred that the longitudinal and lateral channels have approximately the same cross-sectional size, other configurations are also possible. The preferred configuration of the longitudinal channel is for it to occupy substantially all of the end of the module. Similarly, it is preferred that the lateral channels occupy substantially all of the total area of the sides of the module, and this may be in form of one or more lateral openings. In FIG. 2 the preferred shape of the longitudinal and lateral channels forms an inverted U-shape although other shapes are also possible.

In FIG. 2 the overall configuration of the module 1 has an inverted U-shape which is elongated in the longitudinal direction. The length L of each module may range between two feet and twenty feet or more and is preferably about fourteen feet. The span or width W of each module may be two feet to ten feet or more and is preferably about seven feet. So it can be seen that the opposing interior surfaces of the side portions 13 generally define a span which is less than the length of the deck portion and side portions. The thickness T of the deck portion and side portions is in the range of six inches to twelve inches or more. By way of example, but not limitation, a thickness of eight inches has been found suitable for widths of six feet. The height of the module has an approximate range of two feet to twelve feet, and is preferably about five or six feet. It is preferred that the longitudinal and lateral channels have approximately the same cross-sectional size. The height of the channels ranges approximately between one foot to five feet. The width of the channels can range approximately between one foot and ten feet, preferably approximately between four feet and seven feet, and with the preferred width ranging approximately between five feet and six feet.

Figure 3:
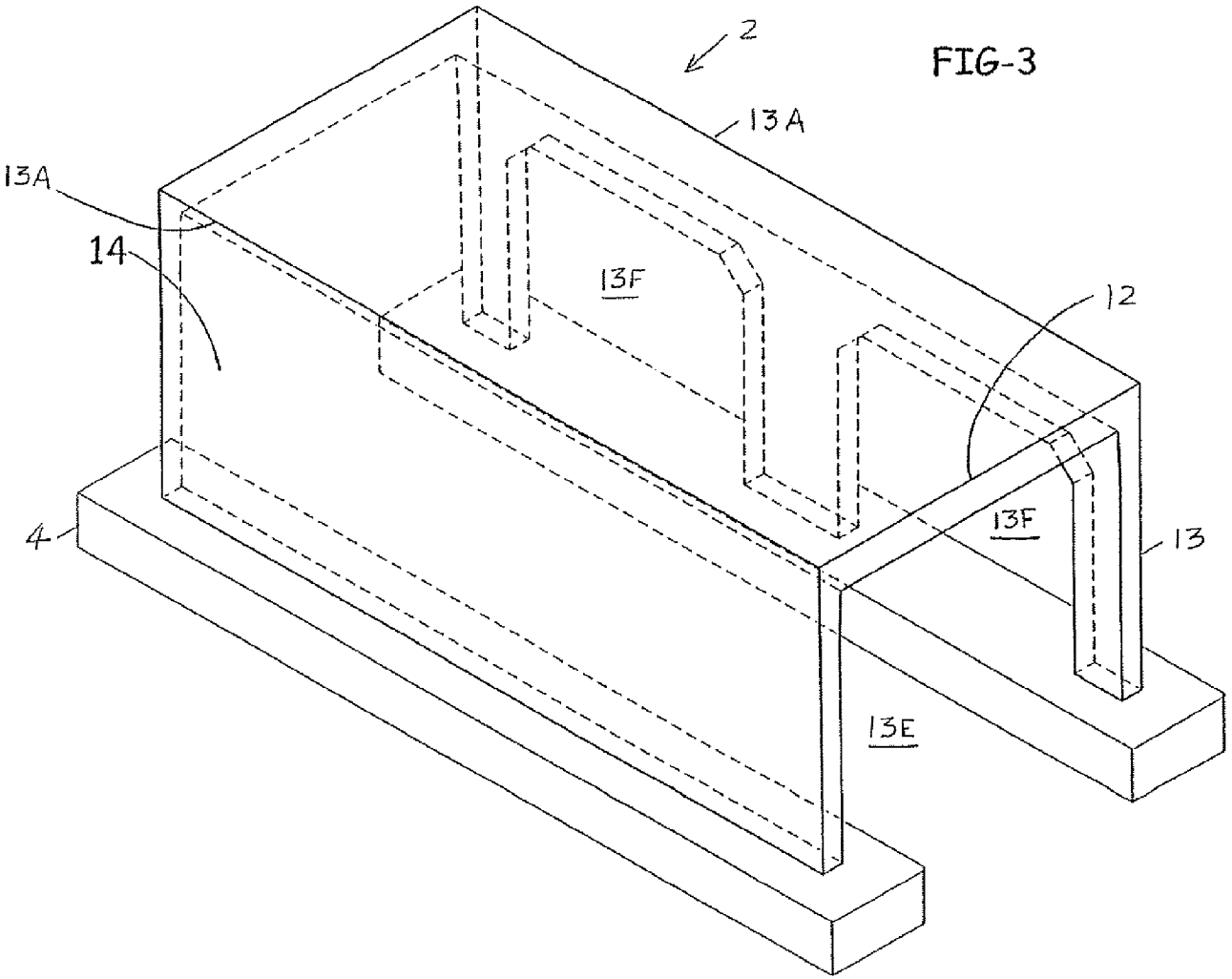
FIG. 3 is a perspective view of a second embodiment of a module shown in FIG. 1.

Turning now to FIG. 3, a second embodiment of a module is illustrated in the form of a side module 2, which was previously identified in the assembly FIG. 1. The side module 2 is disposed peripherally of the interior module 1 in FIG. 1 and has some of the same parts such that the same numbers will be used to designate like parts. In FIG. 3 the side module 2 includes a corresponding substantially horizontally disposed deck portion 12 and two substantially vertically disposed side portions 13, 14 which extend from opposite longitudinal sides 13A of the side module deck portion. The side portions 13, 14 are preferably integrally connected to the deck portion. Together, the deck portion and side portions define a corresponding longitudinal channel 13E. The side portion 13 includes openings defined therein which defines lateral channels 13F, while another side portion 14 is without openings. The longitudinal and lateral channels 13E, 13F of the module 2 fluidly communicate with one another to allow relatively unconstrained fluid flow in the longitudinal and lateral directions in a similar manner as described for the module 1. The construction and dimension of the side module is preferably the same as that described for the interior module 1 although other modifications are possible and will be discussed below. In FIG. 3, while the side portion 14 is shown as a substantially vertical wall which is imperforate, it is also possible for the side portion 14 to include one or more assembly inlet or outlet ports as necessary in order to allow inflow and outflow of storm water as well as other fluids.

Alternatively, as shown in FIG. 1, in addition to the side modules 2, other embodiments of modules are also possible at the periphery of the assembly. A third embodiment includes rear corner modules 15A, 15B. A fourth embodiment includes front corner modules 15C, one front corner module being shown by way of example. Each corner module 15A, 15B, 15C has a substantially vertical wall extending from the deck portion at one of the front or rear longitudinal ends of the deck portion. The vertical wall defies an outer boundary of the assembly. In this way, the modules 15A, 15B, 15C have one closed longitudinal end and one closed lateral side which intersect one another at one of the corners of the module. As shown in FIG. 1, the corner modules 15A, 15B, 15C are preferably placed at the front and rear corner locations of the assembly.

The dimensions of the corner modules may be similar to those described for FIGS. 2 and 3 although the actual dimensions will vary on the requirements of the plan site. For example, in the assembly of FIG. 1, the front corner module 15C has dimension similar to module 1 or module 2. The rear corner modules 15A, 15B have a shorter length due to the preferred plan area of the parking lot under which the assembly is placed. The rear corner modules 15A, 15B have a length approximate to half of the length of the modules 1, 2 or a length which defines one of the lateral channels (not shown) that was previously shown and described in FIGS. 2 and 3. Each rear corner module 15A, 15B preferably defines one longitudinal channel and one lateral channel, similar to those channels previously described in FIGS. 2 and 3, to allow relatively unconstrained fluid flow between the channels.

In FIG. 1, a fifth embodiment of a module is illustrated in the form of front end modules 15D which are placed between the front corner modules, only one front corner module 15C being shown. In FIG. 1, each end module 15D defines one longitudinal channel along its length and two lateral channels defined by its two side portions, similar to the previously described module 1, except that the front end module 15D further has a substantially vertically disposed end wall 14A which is preferably used to define an assembly outer boundary.

In FIG. 1 a sixth embodiment of a module shows rear end modules 15E extending between the rear corner modules 15A, 15B. The rear end modules 15E preferably have a similar length to the rear corner modules 15A, 15B and define one longitudinal channel and one lateral channel (not shown). It will be understood that a substantially vertical end wall (not shown) extends from one longitudinal end of the deck portion in a similar manner as shown for the front end modules 15D so as to define an outer boundary for the assembly.

Turning to FIG. 4, the side portions and deck portion of the module are preferably formed as one integral piece. The module 1 of FIG. 2, the module 2 of FIG. 3 and the other side, end and corner modules are preferably made of precast concrete having a high strength. Preferably, the modules are formed with embedded reinforcements 16 which may be steel reinforcing rods, prefabricated steel mesh or other similar reinforcements. As shown in FIG. 4, a grid of reinforcements 16 such as crossing steel reinforcing rods or prefabricated steel mesh is embedded within deck and side portions of the module 1. The requirements for the size and location of such reinforcement are well known in the trade. The reinforcement is customarily designed by a licensed structural engineer who designs the reinforcement to work with the concrete to provide sufficient load carrying strength to support earth and/or traffic loads placed upon the modules. In place of the reinforcing bars or mesh, other forms of reinforcement may be used such as pre-tensioned or post-tensioned steel strands or metal or plastic fibers or ribbons. Alternatively, the modules may be comprised of hollow core material which is a precast, prestressed concrete having reinforcing, prestressed strands. Hollow core material has a number of continuous voids along its length and is well known in the industry for its strength. Where the modules are located at or beneath a traffic surface such as, for example, a parking lot, street, highway, other roadways or airport traffic surfaces, the module construction will meet American Association of State Transportation and Highway Officials (AASTHO) standards. Preferably, the construction will be sufficient to withstand an HS20 loading, a known load standard in the industry, although other load standards may also be used.

FIG. 4*a* illustrates a modified module 2A which is similar to the module 1 of FIG. 2, which like parts shown with like number, except that the module 2A includes a floor F which extends between the bottom edges 13B of the side portions 13. The floor may be integrally formed with the side portions 13 and may be perforate or imperforate, as desired by the site requirements. In FIG. 4*a* the longitudinal channel 13C defined by the deck portion 12 and the side portions 13 extends upwardly from the bottom edges 13B of the side portions 13. The lateral channel 13F likewise extends upwardly from the bottom edges 13B. It is understood that both the longitudinal and lateral channels extends from the top surface of the floor F to allow flow in the longitudinal and lateral directions.

FIG. 5 illustrates a series of interior modules 1, which are similar to the module described in FIG. 2 and placed in end-to-end series configuration. Each module has side portions 13 with side-by-side openings defining lateral channels 13D. In FIG. 5 the interior modules are placed so that the longitudinal ends of each channel are in alignment. The series of modules form a continuous longitudinal channel, which is made of the individual longitudinal channel 13C (FIG. 4) of each of the modules 1. In FIG. 5 the side portions 13 of each module include up to three legs 17 or more which support along the length of the deck. End legs E are preferably smaller and than intermediate legs M. In FIG. 5, the intermediate legs are twice are wide as the end legs although other configurations are possible. The preferred cross-sectional dimensions of the leg are in the range of five inches by five inches to twenty-four inches by twenty-four inches with a cross sectional dimension of five inches by twelve to twenty-four inches found suitable for leg lengths up to twelve feet. By way of example, but not limitation, the end legs may be twelve inches wide by five inches thick and the intermediate legs M are typically twenty-four inches wide by five inches thick. In FIG. 5 the legs are supported on top of a footing 4 although they may instead be supported by a floor, as previously described.

Turning briefly back to the assembly of modules illustrated in FIG. 1, it will be seen that the modules may be arranged in what can be described as rows and columns. That is, one way of combining the modules is in a reticulated configuration. The series of interior modules 1 of FIG. 5 is placed within the assembly in an end-to-end configuration to form what shall be referred to as columns. The columns are disposed alone the longitudinal direction A of the assembly. A second column of interior modules is placed adjacent to the first column and is aligned (an in abutment) therewith to form an array of columns and rows. The rows are disposed along the lateral direction of the assembly. The adjacent lateral channels are aligned with each other. In FIG. 1, a plurality of interior modules preferably are placed within the assembly to form several columns and rows in end-to-end and side-by-side configuration. In FIG. 1, a plurality of continuous longitudinal channels are generally disposed in parallel with one another and intersect a plurality of continuous lateral channels which also are generally parallel with each other.

In FIG. 1, side modules 2 are disposed at the periphery of the outermost interior modules. Preferably, the side modules are longitudinally and laterally aligned in relation to the interior modules so as to form a portion of the continuous longitudinal and lateral channels. Both interior and side modules provide a portion of the total storage volume of the assembly. Preferably, one would use side modules 2 to form two columns, one column at each outside location of the plurality of interior modules 1, so as to define outer side boundaries to the assembly, as shown in FIG. 1. Each side module 2 provides a portion of a respective continuous longitudinal channel along the longitudinal direction A and provides a portion of (preferably) two continuous lateral channels which are disposed in the lateral direction B. The rear corner modules 15A, 15B and rear end modules 15E provide an outer boundary at the rear end of the assembly. Each of these rear modules 15A, 15B, 15E also forms a portion of a continuous longitudinal and lateral channel. Similarly, the front corner module 15C and front end modules 15D form portions of the continuous channels at the front boundary of the assembly.

In FIG. 1, the continuous longitudinal and lateral channels provide for relatively unconstrained storm water flow between the modules in both the longitudinal direction A and the lateral direction B of the assembly. The side modules 2, corner modules 15A, 15B, 15C and end modules 15D, 15E provide an outer boundary to the assembly. As previously discussed, any one (or more) of the modules may permit controlled access to the assembly in the form of assembly inlet and outlet ports 9, 10, 11. The inlet ports 8 may be defined in the interior modules 1, in the side modules 2 or in combination thereof to permit influent into the assembly. The inlet and outlet ports may be customized into virtually unlimited locations and elevations as desired by the plan area requirements.

Alternately, it is also possible to place adjacent columns in an offset or staggered orientation, such as, for example, an orientation commonly used for laying bricks, while still providing aligned lateral channels. In FIG. 1*a*, a second assembly embodiment illustrates such an orientation. In FIG. 1*a*, an interior module 1 is offset from corner modules 15C, 15F. The corner modules 15C, 15F together with end modules 15E define an outer boundary. It will be realized that corner module 15F is a mirror view of corner module 15C along a longitudinal line of symmetry. Even though the ends of an individual interior modules are not aligned with both ends of a module in an adjacent column, but is offset therefrom, the longitudinal and lateral channels of each module are aligned to form continuous channels. For example, one lateral channel of the interior module 1 is aligned in a row with one lateral channel defined in each pair of laterally aligned corner modules 15C, 15F. Another lateral channel of the interior module 1 is aligned in a row with one lateral channel defined in each second pair of laterally aligned corner modules 15C, 15F. End modules 15E are placed between each pair of corner modules and also form a portion of the continuous channels. The modular assembly of FIG. 1*a* is shown by way of example but not limitation, as other assembly configurations are possible and may depend on the plan area requirements.

Turning now to FIG. 6, the side module 2 is illustrated rotated 180° about a vertical axis relative to the view shown in FIG. 3. When the side modules are required to support lateral loads that exceed the structural capacity of the cantilever beam configuration of the side modules, one or more integral structural braces 18 may be added. This variation is illustrated in FIG. 6.

Referring to FIG. 7, a seventh embodiment of a module 19 is illustrated which is similar to the module of FIG. 2 with like parts shown with like numbers, except that this module 19 may be configured to include an upper traffic surface 20 to be used at grade level, illustratively. This offers the economics of additional pavement not being required in the area of the storm water retention/detention channel. To enhance the visual attractiveness of the upper traffic surface of the deck of the modules, the upper surface 20 may include architectural fishes which are either added to the top surface of the deck portion 12 or which may be embossed into the deck portion when it is manufactured using molds or other tooling. These embossed surfaces may include but not be limited to simulated brick in various patterns, simulated stone pavers, and graphic illustrations. Also actual brick or stone pavers or cut stone may be inset into the top surface of the deck portion as a further architectural enhancement. For example, each of the modules in FIG. 1 may be provided with an upper surface 20 with the assembly being installed at an elevation which allows the upper surface of the assembly to form the traffic surface of the illustrated parking lot.

FIGS. 8 and 9 illustrate another aspect of the invention that will be generally described herein as a double depth or double level configuration. When site specific inlet and outlet elevations allow increased depths up to 10 feet and more, the storm water detention and/or retention system may be assembled with two levels of modules disposed one above the other. FIG. 8 shows an arrangement of the modules which is similar to the view shown in FIG. 1 except that it includes a plurality of lower modules 21A, 21B, 21C, 21D and a plurality of upper modules 22A, 22B, 22C, 22D.

In particular, the layer of lower modules is comprised of interior modules 21A and side modules 21B which are similar to the interior modules 1 and side modules 2 already described relative to FIG. 1 except that the lower modules are placed within the ground with their respective deck portions being at the bottom and the side portions extending upward therefrom. The lower modules are preferably rotated 180° along a horizontal axis relative to the orientation described for the single depth configuration of FIG. 1. Corner modules 21C are disposed at the lower corner modules of the assembly. End modules 21D are disposed between the lower corner modules 21C. Both the corner and end modules 21C, 21D are placed upright within the assembly. The layer of upper modules comprises interior modules 22A, side modules 22B, corner modules 22C and end modules 22D, similar to those described in FIG. 1, and like numbers will be used to identify like parts. Each of the upper and lower modules includes longitudinal and lateral channels, as described relative to FIGS. 2 and 3. In FIG. 8, the longitudinal channels are aligned along the longitudinal direction A, and the lateral channels are aligned along the lateral direction B of the assembly.

In FIG. 8, each of the lower modules 21A, 21B, 21C, 21D preferably have a U-shape, and the upper modules 22A, 22B, 22C, 22D have an inverted U-shape. Each lower module includes a deck portion 24 which forms a portion of a floor of the assembly. The floor may be perforate or imperforate. As illustrated in FIG. 8, the assembly has some deck portions which have no openings, and other deck portions which have openings. For example, one or more of the deck portions 24 may have one or more openings 23 defined therein to permit fluid to exit the assembly through these openings. In FIG. 8 the opening 23 is shown spaced from the longitudinally disposed ends and laterally disposed sides of the modules although other orientations are also possible.

Turning first to the lower interior modules 21A, each lower interior module 21A includes side portions 24A which define two lateral channels, similar to those channels previously described for the single depth configuration, except that the side portions extend upwardly from each longitudinal side edge of the deck portion to define an upright U-shape. The side portions of the lower interior modules 21A support corresponding side portions 13 of the upper interior modules 22A.

Each lower interior module further has at least one passageway 23A which is formed in at least one of the side portions. The passageways 23A extends upwardly from the deck portion 24, and each one is preferably located below and sized smaller than the corresponding lateral channel defined in the side portion. Although the passageway 23A is shown as a separate opening than the lateral channels, it is also possible that the passageway 23A may be formed as part of the lateral channel thus extending the lateral channel to the deck portion or floor of the assembly. By way of example, in FIG. 8, it can be seen that the lower interior modules 21A have passageways 23A formed in each side portion 24A. The passageway 23A of the module 21A preferably is aligned with a corresponding passageway 23A formed in an adjacent lower module 21A. The passageways 23A provide for unrestricted flow of the storm water between the lower modules. In FIG. 8, passageways 23A are also defined in side modules 21B, corner modules 21C and end modules 21D of the lower modules.

In FIG. 8, each of the lower side modules 21B includes one side portion 24B which defines two lateral channels and another side portion 24C which provides a section of an outer boundary to the assembly. Some of the side portions 24C are illustrated without openings or imperforate, and other side portions are illustrated as perforate with one or more inlet ports 9 or outlet ports 11 defined therein. As previously described relative to the single depth modular assembly, other combinations of inlets and outlets to the assembly are possible. Each of the lower corner modules 21C and lower end modules 21D also includes corresponding side portions, one side portion 24D of the end module 21D being shown by way of example and defining one lateral channel. In FIG. 8 when the upper and lower modules are combined, the individual longitudinal and lateral channels of the upper and lower modules are vertically aligned to define corresponding continuous longitudinal channels 24E and corresponding continuous lateral channels 24F. The upper modules are oriented in an inverted U-shaped with the side portions of the upper modules being supported on the side portions of the upright lower modules.

Placement of the double depth configuration preferably involves placing one or several adjacent lower modules in an excavated site and then placing the corresponding upper modules on top of the lower modules. These steps are preferably repeated until the entire assembly is completed, although other configurations are possible. For example, one or more rows or columns, or even all the lower modules in the entire reticulated assembly, may be placed in the site before placing the upper modules on top of their respective lower modules. If desired, the upper and lower modules may be secured or fastened to each other using any conventional methods. By way of example, but not limitation, the upper and lower modules may be secured by an interlocking structure where each bottom edge of their respective side portions has a beveled shape, as illustrated in the alternate embodiments of FIGS. 13*f*-13*h*. Other variations are also possible.

The double depth configuration of FIG. 8 has the advantage that the deck portion of the lower module provides a floor which assists in structurally supporting the assembly on the underlying soil relative to vertical loads applied to the assembly. Thus no secondary in-situ or precast concrete footings are necessary. The ranges of overall dimensions of each upper and lower module are similar to those previously described for the single depth module. The overall height dimension of the assembly is additive of the heights of both the upper and lower modules to provide a greater storm water storage capacity. The heights of the upper and lower module layers need not be the same and may vary in relation to each other. This double depth configuration includes all the features, advantages, and embodiments detailed for the single depth configuration.

FIG. 9 demonstrates a further embodiment of the modular assembly. The assembly of FIG. 9 shows the versatility and easy connectability of the modules and how the modules can be assembled in configurations that are adaptable to a specific site's physical area constraints and underground obstacles such as plant root systems 25 or underground utilities 26. Due to the modular design, the plan area is not constrained to simple rectangular shapes, but the modules may be combined in any free form plan area shape available within the constraints of the site. In accordance with features already described, the modules form corresponding longitudinal channels in the longitudinal direction A of the assembly and corresponding lateral channels in the lateral direction B.

FIG. 9 illustrates an assembly configuration which includes a combination of lower interior modules (not shown), lower side modules 21B, lower corner modules 21C, lower end modules 21D, upper interior modules 22A, upper side modules 22B, upper corner modules 22C, and upper end modules 22D. The assembly of FIG. 9 furthers includes lower double-sided modules 21E having closed lateral side portions on both sides of the module. Upper double-side modules 22E are supported by the lower modules 21E in some areas, and, in other areas, a single depth module 22F may be used without a supporting lower module. The single depth module 22F preferably includes an imperforate floor to avoid interfering with the utilities 26 or other underground obstacles and is raised above the level of lower modules using earth or other fill materials. So it can be seen that the assembly may include both single and double depth configurations as is required by the specific site conditions. Illustratively, this assembly supports the loads associated with a parking lot and forms a traffic surface for the parking lot.

FIG. 10*a* is a cross-sectional end view, similar to FIG. 4, which illustrates a group of interior modules 1 in another aspect of the invention. The interior modules 1 are laterally spaced apart from one another. A connecting portion 27 having two ends 27A and 27B is placed between the interior modules. The connecting portion is preferably made of a flat, precast concrete slab or hollow-core panel and has approximately the same thickness, width and length of the deck portion 12 of the module 1. The connecting portion preferably is six feet wide and fourteen feet long although the connecting portion may have other lengths and widths. Other orientations of the connecting portion are also possible. By way of example but not limitation, the interior modules could be spaced further apart, and several connecting portions may be placed lengthwise between the modules.

In FIG. 10*a*, at least one side portion of each module has a longitudinally extending recess 28 to support one end of the connecting portion and transfer lateral loads. An intermediate longitudinal channel 28A is defined between the side portions 13 of the spaced apart modules and the connecting portion 27. This longitudinal channel 28A extends upwardly from the bottom edge 13B of the side portions and is in fluid communication with the lateral channels 13D defined by the side portions 13. Both the lateral and longitudinal channels allow for relatively unconstrained flow of storm water throughout the assembly. It is realized that the modules will be provided with an imperforate or perforate floor which is relatively level with the top elevation of the footings 4 so that the channels extend completely to the floor of the modules.

FIG. 10*b* shows a modified configuration of spaced apart modules where each of the modules includes a longitudinally extending ledge 29. The ledge 29 is spaced from the top surface of the deck portion at distance which is approximate to the thickness of the connecting portion 27. In FIG. 10*c*, a modified connecting portion 30 has a lower surface which includes longitudinal located depressions 30A, 30B located adjacent the respective longitudinal ends 27A, 27B of the connecting portion. An upper surface of the connecting portion 30 is slightly elevated relative to the deck portions 12 of the modules. The depressions 30A, 30B facilitate the transfer of lateral loads to the assembly. The spaced apart configuration of modules with a connecting portion spanning between the modules may be utilized with any of the aspects discussed herein. Other locations for the depressions may be utilized where, for example, a different orientation is desired for the connecting portion 30 relative to the modules.

In another aspect of the invention, FIGS. 11*a* and 11*b* illustrate an eighth embodiment of a module. FIGS. 11*a* and 11*b* show a module 31 which has a substantially horizontally disposed deck portion 31A and one substantially vertically disposed side portion 31B, which are like those previously described relative to FIG. 2, except that the module 31 has one side portion. The side portion 31B extends integrally from one longitudinally disposed side of the deck portion opposite a longitudinally disposed free side 31C. The module 31 has an inverted L-shape which is elongated in the longitudinal direction. The module 31 has overall dimensions similar to those previously described and is also supported by a footing 4 or a floor and aggregate material 5 (not shown). A first longitudinal channel 31D is formed by the interior surfaces of the deck portion 31A and side portion 31B of the L-shaped module 31 and extends upwardly from the bottom edges 31E. Lateral channels 13F are formed in the side portion 31B preferably in a side-by-side parallel orientation. The first longitudinal channel 31D fluidly communicates with the lateral channels 31F.

The configuration of FIGS. 11*a* and 11*b* further includes a support module 32 which supports the free side 31C of the inverted L-shaped module 31. In FIGS. 11*a* and 11*b*, the support module 32 preferably has an inverted U-shape similar to the module 2 described in FIG. 3. Alternatively, a variety of support members rather than the illustrated support module may be used to provide a support to the module 31. In FIG. 11*a*, the support module 32 includes a corresponding horizontally disposed deck portion 32A, two corresponding side portions 32B, 32C, and corresponding bottom edges 32E. The support module 32 further defines corresponding longitudinal and lateral channels 32D, 32F, respectively. A longitudinally extending recess 32G is formed in the support module 32 at a location where the side portion 32B extends from the deck portion 32A.

As shown in FIGS. 11*a* and 11*b*, the free side 31C of the inverted L-shaped module 31 is received within the longitudinally extending recess 32G of the support module 32. In addition to the first longitudinal channel 31D already defined by the module 31, the longitudinal channel 32D formed by the support module 32 forms a second longitudinal channel. The lateral channels 32F of the support module 32 permit fluid communication between the first and second longitudinal channels 31D, 32D. The other side portion 32C of the support module 32 defines an outer boundary to the assembly and may either be imperforate, as shown in FIG. 3, or define one or more assembly access inlet or outlet ports, as shown in FIG. 1.

In FIGS. 11*a* and 11*b*, the configuration may include two or more modules 31. Each module 31 preferably has a longitudinally extending recess 31G within the side portion 31B to provide support to the next adjacent module 31. The lateral channels 31F permit fluid communication between the longitudinal channels 31D of adjacent modules 31.

Relative to FIGS. 11*a*-11*c*, any number of modules 31 may be laid side-by-side in a row of any length as determined by the site requirements. Other rows may be placed adjacent to the rows illustrated in FIGS. 11*a* and 11*c* thus forming columns and rows which are aligned longitudinally and laterally. Preferably, the outermost inverted L-shaped module is formed with a side portion which is either imperforate or has one or more assembly access ports to define an outer boundary.

Numerous variations are possible using the embodiment shown in FIGS. 11*a* and 11*b*. For example, where the site requirements desire that the row of modules include only one inverted L-shaped module 31 and one support module 32, then the side portion 31B of the module 31 preferably defines an assembly boundary. Alternatively, where the row is formed from a plurality of inverted L-shaped modules 31 placed in series, each module 31 defines at least one lateral channel 31F for fluid communication between adjacent longitudinal channels, except that the outermost module (not shown) located at the periphery of the assembly which has a side portion that is formed without a lateral channel.

FIG. 11*c* illustrates a modified inverted L-shaped module 33 and modified support module 34, and uses the same alphabetical suffixes which were used for modules 31, 32 in FIGS. 11*a* and 11*b* to refer to the same pans, except instead of recesses, the support module 34 includes a longitudinally disposed ledge 34H. Corresponding ledges 33H are disposed on the inverted L-shaped module 33 to support adjacent L-shaped modules 33. Other supporting structures may also be utilized in addition to the illustrated structures.

The assemblies illustrated in FIGS. 10*a*-11*c* may include all the features, advantages, and embodiments previously detailed for the previously described single depth and double depth assembly configurations. The inverted L-shaped module configuration has the advantage of eliminating one of the side portions between adjacent modules. Also, this configuration may be nested together for occupying reduced space when warehoused prior to installation or when transported on trucks. Other combinations of side portions are also possible in accordance with other aspects of the present invention. The assembly may also be configured such that the inverted L-shaped modules 31, 33 may be placed on both the left and right of a support module 32, 34 and branch outwardly therefrom. Various other combinations are also possible which utilize the embodiments described herein.

In FIG. 12*a*, a ninth embodiment of a module utilizes an upright U-shaped module 38 that is placed within the ground and oriented similar to the lower module of the double depth configuration of FIGS. 8 and 9. The U-shaped module 38 includes a corresponding deck portion 38A and side portions 38B which define a corresponding longitudinal channel 38D. At least one lateral channel (not shown) is formed in the side portions 38B in accordance with those features previously described for the lower module. The U-shaped module 38 is placed in a side-by-side configuration, as shown in FIG. 12*a*, or in parallel spaced relation, as shown in FIG. 12*b*. Additional rows of modules may be placed in end-to-end alignment thus forming columns and rows of modules in an assembly. The side portions 38B support a top deck 40 which is preferably composed of precast concrete flat slabs or hollow-core panels. A side module 39 includes a corresponding deck portion 39A and two side portions 39B, 39C and defines another longitudinal channel 39D. One side portion 39B includes at least one lateral channel (not shown) as previously described relative to earlier embodiments. Preferably, the side portion 39C forms an outer boundary. The lateral channels allow for relatively unconstrained storm water flow between first and second longitudinal channels 38D, 39D, as shown in FIG. 12*a*, or first, second and intermediate channels 38D, 39D, 40D, as shown in FIG. 12*b*. This configuration includes all the features, advantages, and embodiments previously detailed for the single depth and double depth configurations.

FIGS. 13*a*-13*h* illustrate that the modules may be modified to incorporate integral pads or footings and floors which extend integrally from the bottom edge of the side portion. Although not shown in the figures, the pads or footings will be provided with aggregate material placed between adjacent footings, similar to the material 5 illustrated in FIG. 1, to form a porous floor. The footings or floors facilitate support of the assembly on the underlying soil against the vertical loads which are applied to the assembly. Any one of the modules shown in FIGS. 13*a*-13*h* may include all the features, advantages, and embodiments previously detailed for the single depth and double depth configurations. The same alphabetical suffixes will be used to designated the same parts, where shown.

FIG. 13*a* shows a single depth module 41 which may be similar to any of the modules previously described, such as the module 1 or module 2. As shown in FIG. 13*a*, the module 41 includes a deck portion 41A, side portions 41B having bottom edges 41E, a longitudinal channel 41D, and integral footings 41I which extend from the bottom edges 41E of the side portions.

FIG. 13*b* shows an integral pad 421 in a module 42 which is similar to the inverted L-shaped module 31 described in FIGS. 11*a*-11*b*. As shown, the module includes a deck portion 42A, side portion 42B, a free side 42C, a longitudinal channel 42D, and bottom edges 42E of the side portion.

FIG. 13*c* shows a tail portion 43J which is integrally formed as part of a module 43, which module is similar to the module 33 described in FIG. 11*c* and like parts will be referenced with similar alphabetical suffixes. The tail portion 43J is integrally formed on the side portion at a location which is opposite the deck portion, and the tail portion 43J extends outwardly from the side portion in a direction opposite and parallel to the deck portion.

FIGS. 13*d* and 13*e* illustrate modules 45, 46 which are similar to the L-shaped modules in FIGS. 11*a* and 11*b*, with like parts numbered with the alphabetical suffixes, except that instead of the footings 4 shown in FIGS. 11*a* and 11*b*, modules 45, 46 in FIGS. 13*d* and 13*e* include an integral floor 45K, 46K, respectively. In FIG. 13*d*, the floor 45K extends from a bottom edge 45E of one side portion 45B at a location opposite a deck portion 45A and in a direction parallel to the deck portion. The addition of the floor to the L-shape configuration may also be described as a Z-shape. The recesses 45G receive and support a free side 45C of an adjacent deck portion. The floor 45K includes a corresponding free end 45L which extends to an adjacent side portion 45 to form a continuous floor. The top surface of the floor forms the bottom of both longitudinal and lateral (not shown) channels. Although not specifically shown in this embodiment, at least one lateral channel preferably extends upwardly from the bottom edge 45E of the side portion 45B, as previously described relative to the other embodiments, to provide relatively unconstrained fluid flow.

Similarly, the module 46 of FIG. 13*e* also illustrates a Z-shaped configuration. The module 46 includes an integral, continuous floor 46K which extends from a corresponding side portion 46B at a location opposite a corresponding deck portion 46A. The module 46 of FIG. 13*e* is similar to the module 45 of FIG. 13*d*, and includes parts with like suffixes, except that the module 46 includes a lower longitudinal recess 46M which is formed at the bottom edge 46E of the side portion 46B. The recess 46M receives the free end 46L of the floor 46K of an adjacent module 46. Although not shown, at least one lateral channel extends upwardly from the bottom edge 46E, as previously described with other embodiments.

FIG. 13*f* illustrates a tenth embodiment of a module 48 in another aspect of the invention. The module 48 has a Z-shaped configuration, similar to the module 45 illustrated in FIG. 13*d*, except that the modules 48 of FIG. 13*f* provide a double depth configuration. Each module 48 includes corresponding reference numerals with similar suffixes for corresponding parts as follows: a deck portion 48A, one side portion 48B which extends from one longitudinal side of the deck portion, a free end 48C, a longitudinal channel 48D, bottom edges 48E, two lateral channels 48F, longitudinal recesses 48G and a floor 48K which extends outwardly from the side portion in a direction which is opposite to the deck portion and which extends in a direction parallel to the deck portion. The longitudinal and lateral channels 48D, 48F have similar approximate ranges of dimensions to the longitudinal and channels previously described for the double depth configuration of FIG. 8.

In FIG. 13*f*, a support module, generally indicated at 50 and comprised of upper and lower modules 52, 54, supports a free end 48C of the deck portion 48A in a longitudinal recess 52G. Each of the upper and lower modules includes a corresponding deck portion 52A, 54A, respectively. Upper module 52 includes corresponding side portions 52B, 52C, and lower module 54 includes corresponding side portions 54B, 54C. As noted previously, each upper side portion has a beveled bottom edge, as shown, which fits with a mating beveled edge of a corresponding lower side portion when the upper and lower modules are placed in vertical alignment with one another. The interior surfaces of the deck portion and side portions of both upper and lower modules 52, 54 define a second longitudinal channel 60. The side portions 52B, 54B of the upper and lower modules 52, 54 together define two lateral channels 62 disposed in a side-by-side orientation. The opposite side portions 52C, 54C define an outer boundary to the assembly. The lateral channels 62 of the upper and lower modules 52, 54 are aligned with the first named lateral channels 48F of the Z-shaped module 48 to provide fluid communication between the second longitudinal channel 60 and the first named longitudinal channel 48D.

In FIG. 13*f*, a substantially horizontal platform 63 is positioned between the side portion 54B of the lower module 54 and the side portion 48B of the Z-shaped module 48. The platform 63 is preferably located at an elevation approximately level with, and adjacent to, each of the deck portion 54A and the floor 48K. The platform may be connected to one or both of the lower module 54 and the Z-shaped module 48 using conventional methods. The platform 63 forms a bottom surface of the longitudinal channel 48D which is formed directly adjacent and generally parallel to the second longitudinal channel 48D. Alternatively, the platform 63 may be integrally formed with the lower module 54. Subsequent Z-shaped modules 48 have a floor 48K which extends outwardly to an adjacent L-shaped module 48 and forms the bottom surface of the channel 48D. The outermost module of the assembly may be configured as an inverted L-shaped module without an integral floor. Passageways 65 are formed at the bottom of the lower module 54 and the Z-shaped module 48, as previously described in the assembly of FIG. 8, to farther facilitate storm water flow between the modules.

FIG. 13*g* represents a side view of a similar assembly of modules to the assembly illustrated in FIG. 13*f*, except that it includes a Z-shaped module 66 and upper module 68 which each have corresponding ledges 66H, 68H respectively. The ledge 66H of the module 66 is spaced from the upper surface of the module 66 at a distance of approximately the thickness of a deck portion 66A. In FIG. 13*g* like parts are illustrated with like number or shown with similar alphabetical suffixes.

FIG. 13*h* illustrates a further modification which is similar to the assembly in FIG. 13*g*, with like parts illustrated with like numbers or shown with similar alphabetical suffixes, except that the assembly includes a Z-shaped module 74 which has a lower longitudinally extending ledge 74N. The ledge 74N extends outwardly from the side portion 74B opposite the floor 74K and forms a bottom edge 74E of the side portion. The ledge 74N is located on the side portion 74B just above the elevation of the platform 63. The bottom edge 74E contacts one of the floors 74K, 63 when one or more Z-shaped modules 74 are assembled. Other modifications are also possible.

It will be appreciated from the foregoing description that a method and apparatus are provided for retaining or detaining storm water beneath a ground surface. In various aspects, one practices the method preferably by connecting a plurality of longitudinal channels and connecting a plurality of lateral channels. The longitudinal channels preferably are each defined by at least one substantially horizontal deck and at least one substantially vertical side wall. The lateral channels are each defined preferably by a portion of a corresponding deck and a portion of a corresponding side wall. Preferably, both the longitudinal and lateral channels have relatively the same cross-section and are in longitudinal and lateral alignment to form continuous longitudinal and lateral channels. The respective longitudinal and lateral channels are preferably adjacent one another although they may be disposed in other configurations as desired by the existing or planned underground obstacles. Preferably, the side wall has a bottom edge, and both the channels extend upwardly from a corresponding bottom edge of the side wall to allow relatively unconstrained water flow in the longitudinal and lateral directions.

The method further includes creating an outer boundary for the longitudinal and lateral channels and placing the peripheral walls around the channels. Portions of the peripheral walls include an assembly access port such as inlet or outlet ports to receive storm water within the assembly.

In one aspect, the method includes connecting longitudinal and lateral channels which are defined by at least one interior module having a corresponding deck portion and at least one side portion. For example, the assembly of FIG. 1 includes connecting a plurality of interior modules 1 of FIG. 2 which are placed within an excavation site. The step of connecting preferably includes aligning the ends of adjacent modules so that the individual longitudinal channels 13C of each interior module form a continuous longitudinal channel through the entire assembly. Preferably, the step of connecting further includes aligning the sides of adjacent modules so that the individual lateral channels 13D of each interior module form a continuous lateral channel through the entire assembly. Side modules 2, corner modules 15A, 15B, 15C and end modules 15D, 15E are placed peripherally around the interior modules in an aligned configuration so that their corresponding longitudinal and lateral channels form a portion of the continuous channels. The vertical walls of the side, corner and end modules are located at the periphery of the assembly and have either an imperforate or perforate surface and may define inlet and outlet ports.

After the particular site has been excavated and the underground obstructions accounted for, a first module is placed into the ground. The first module may be any one of an interior module, a side module, a corner module or an end module. Adjacent modules may be placed in longitudinal and lateral alignment with the first modules to form continuous longitudinal and lateral channels. Interior modules are placed towards the interior of the assembly while side modules, corner modules and end modules are placed at the periphery of the assembly. So it can be seen that the modules may be placed in any order within the ground to connect the channels.

Although each module in FIG. 1 is shown as placed in end-to-end, side-by-side and adjacent alignment, it is also possible to place the modules in a spaced apart configuration with connecting portions spanning between the spaced apart modules. The assembly access inlet and outlet ports can be located in predetermined locations or formed in the side portions during installation in order to ensure that the inlet and outlet ports are aligned with existing underground drains and conduits. Alternatively, an outlet port may not be required where the floor of the assembly is perforate such as, for example, where the floor includes one or more openings or is formed of a porous or aggregate material which allows for percolation of the storm water into the ground.

Storm water flows into the assembly through one or more of the inlet ports, is stored for a certain interval of time and then flows out of the assembly either through one or more outlet ports, through a porous or perforate floor, or a combination of both. During entry and storage of the storm water within the assembly, the laterally and longitudinal aligned channels allow relatively unconstrained water flow in the lateral and longitudinal directions. The assembly may be sloped such that the portion of the assembly having an inlet port is located at a slightly higher elevation while the portion of the assembly having an outlet port has a lower elevation to ensure that the storm water flows under the influence of gravity.

In another aspect of the invention, the method may comprise the step of placing a support module beneath the ground surface prior to the steps of connecting the longitudinal and lateral channels. For example, the L-shaped modules of FIGS. 11*a*-11*b* preferably require the support module 32 to be placed in the ground to facilitate placement of the L-shaped modules 31. Thereafter, one or more L-shaped modules are placed in the ground and longitudinal and lateral channels defined by the modules are connected to one another. The final L-shaped module which defines a peripheral wall of the assembly is then placed within the ground to define an outer boundary to the assembly. Similar steps may be used to assemble the configurations shown in FIGS. 13*a*-13*h* although the assemblies of FIGS. 13*f*-13*h* further include the step of placing a platform 63 prior to the steps of connecting the longitudinal and lateral channels.

In a yet further aspect of the invention, the method may include the step of installing a plurality of U-shaped modules within the ground in an upright configuration at a predetermined depth. Lateral and longitudinal aligning corresponding ends and sides of the modules fluidly connect the channels defined by the modules. This method may include placing, a top deck 40 over the upright modules, as shown in either the side-by-side configuration of FIG. 12*a* or the spaced apart configuration of FIG. 12*b*. Alternatively, the upright U-shaped modules form a first or lower level of modules which supports a second or upper level of inverted U-shaped modules placed upright on top of the lower level in vertical alignment.

From the foregoing discussion, the skilled artisan will appreciate that various embodiments of the invention possess or permit in its various applications or embodiments one or more of the following features:

Significant internal volume for horizontal area occupied (i.e. the plan area or footprint of the assembly);

Versatile modular assembly in plan form to fit the constraints of building sites and allow construction around underground obstacles;

Variable optimum size and configuration for manufacturing, transporting, and installing in the ground efficiently;

Substantially minimal excavation required and a reduction in excavated material to be hauled from the building site;

Variable height to match variable influent and effluent elevations;

Structural soundness to permit installation at grade with the upper surface of the deck utilized as a hard traffic surface;

Producible with features permitting use as a hard traffic surface, for example, allowing an embossed architectural finish on the upper surface of a deck portion;

Structural soundness to permit deep burial with up to ten (10) feet or more of earth cover;

Composed of robust, durable material, preferably concrete or hollow core panels, which is proven to withstand a wet underground environment;

Structurally designed by licensed professional engineers utilizing certified design protocols;

Configured for optimum hydraulic flow of storm waters such as statistically predicted storm water events;

Configured for accessibility to permit easy clean out of debris and sedimentations;

Configurable with inlet openings, outlet openings, and clean out manhole openings in any location on the upper and/or exterior wall surfaces of the chamber; and Joints sealed with bitmastic tape and/or wrap or other sealant or protected with filter fabric.

While the underground modular storm water retention and/or detention system herein described constitutes the preferred embodiments of the invention, it is understood that the invention is not limited to these precise modules for forming underground channels and that changes may be made therein. Moreover, it will be understood that one need not enjoy all of the foregoing advantages in order to use the present invention.

Additional features and advantages may be apparent to one skilled in the field upon review of this description. For example, the openings which define the longitudinal and lateral channels may have several geometric shapes other than those illustrated. By way of example, but not limitation, the shape may be concentric through holes which extend from the bottom edges of the modules so as to provide relatively unconstrained storm water flow between the channels. Also by way of example, FIGS. 1, 1*a*, 8 and 9 illustrate different configurations for single and double depth configurations of modules. It is realized that many other geometric configurations for modular assemblies are possible.

The invention claimed is:

1. A method for retaining or detaining storm water beneath a ground surface comprising the steps of:

placing a first level within the ground comprising a plurality of modules in a first configuration, wherein each module comprises a horizontally disposed deck portion and at least one substantially vertically disposed side portion extending therefrom, said deck portion and said side portion have respective end edges, and said side portion respectively having an edge opposite the deck portion;

placing a second level within the ground comprising a plurality of modules in a second or inverted configuration, said inverted modules being supported by the first level, wherein each inverted module comprises a corresponding horizontally disposed deck portion and at least one corresponding substantially vertically disposed side portion extending therefrom, said deck portion and said side portion of said inverted module have respective end edges, and said side portion respectively having an edge opposite the deck portion;

connecting a plurality of longitudinal channels each defined by at least a portion of a selected one of the first level and the second level; and connecting a plurality of lateral channels each defined by at least a portion of a selected one of the first level and the second level.

2. The method of claim 1 wherein at least one deck portion of the second level includes an opening for flow of stormwater.

3. The method of claim 1 wherein the deck portion of the first level forms at least a portion of a floor and such portion is imperforate.

4. The method of claim 1 wherein the deck portion of the first level forms at least a portion of a floor and such portion is perforate.

5. The method of claim 1 wherein said longitudinal channels and said lateral channels are defined in part by the first level, which includes a plurality of elongated U-shaped modules, each module formed from a corresponding deck and two corresponding side walls extending from opposite longitudinal sides of the deck, wherein the steps of connecting said channels include installing a plurality of U-shaped modules within the ground in an upright configuration at a predetermined depth.

6. The method of claim 1 wherein said longitudinal channels and said lateral channels are defined in part by the second level, which includes a plurality of elongated U-shaped modules, each module formed from a corresponding deck and two corresponding side walls extending from opposite longitudinal sides of the deck, wherein the steps of connecting said channels include installing a plurality of U-shaped modules within the ground in an inverted configuration at a predetermined depth above the first level.

7. The method of claim 1 wherein the second level is supported by the first level in vertical alignment.

8. The method of claim 1 wherein side portions of the second level are supported on the side portions of the first level.

9. The method of claim 1 wherein said longitudinal channels and said lateral channels are each defined by respective portions of at least one substantially horizontal deck and at least one substantially vertical side wall of said first and second levels.

10. The method of claim 1 further comprising providing an outer boundary for said channels, said outer boundary being formed by a plurality of peripheral walls that include some wall portions which define no openings and other wall portions which define no openings other than at least one assembly access port located therein.

11. An assembly for retaining or detaining storm water beneath a ground surface comprising:

a first level comprising a plurality of upright modules;

a second level comprising a plurality of inverted modules;

each of said upright and inverted modules having a horizontally disposed deck portion and at least one substantially vertically disposed side portion extending therefrom, said deck portion and said side portion have respective end edges, and said side portion respectively having an edge opposite the deck portion;

a plurality of longitudinal channels each defined by a selected one of said first level and said second level; and a plurality of lateral channels each defined by a selected one of said first level and said second level.

12. The assembly of claim 11 wherein at least one deck portion of the second level includes an opening for flow of stormwater.

13. The assembly of claim 11 wherein the deck portion of the first level forms at least a portion of a floor and such portion is imperforate.

14. The assembly of claim 11 wherein the deck portion of the first level forms at least a portion of a floor and such portion is perforate.

15. The assembly of claim 11 wherein said longitudinal channels and said lateral channels are defined in part by the first level, which includes a plurality of elongated U-shaped modules, each module formed from a corresponding deck and two corresponding side walls extending from opposite longitudinal sides of the deck.

16. The assembly of claim 11 wherein said longitudinal channels and said lateral channels are defined in part by the second level, which includes a plurality of elongated U-shaped modules, each module formed from a corresponding deck and two corresponding side walls extending from opposite longitudinal sides of the deck.

17. The assembly of claim 11 wherein the second level is supported by the first level in vertical alignment.

18. The assembly of claim 11 wherein side portions of the second level are supported on the side portions of the first level.

19. The assembly of claim 11 wherein said longitudinal channels and said lateral channels are each defined by respective portions of at least one substantially horizontal deck and at least one substantially vertical side wall of said first and second levels.

20. The assembly of claim 11 wherein each said channel has about the same cross section.

* * * * *